US007305208B2

(12) United States Patent
Inoue et al.

(10) Patent No.: US 7,305,208 B2
(45) Date of Patent: Dec. 4, 2007

(54) IMAGE HEATING APPARATUS WITH DISCHARGE OCCURRING BETWEEN A CHARGE ELIMINATING MEMBER AND A PRESSURE ROLLER

(75) Inventors: Hiroshi Inoue, Utsunomiya (JP); Atsushi Iwasaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/234,306

(22) Filed: Sep. 26, 2005

(65) Prior Publication Data

US 2006/0067750 A1 Mar. 30, 2006

(30) Foreign Application Priority Data

Sep. 28, 2004 (JP) ..... 2004-281673
Sep. 20, 2005 (JP) ..... 2005-271971

(51) Int. Cl.
*G03G 15/20* (2006.01)

(52) U.S. Cl. ..... 399/328

(58) Field of Classification Search ..... 399/328, 399/67, 333
See application file for complete search history.

(56) References Cited

U.S. PATENT DOCUMENTS

| | | | | |
|---|---|---|---|---|
| 5,055,756 | A | 10/1991 | Ohkoda et al. | 318/618 |
| 5,358,230 | A | 10/1994 | Ikemori et al. | 271/114 |
| 5,485,991 | A | 1/1996 | Hirano et al. | 271/121 |
| 5,525,775 | A | 6/1996 | Setoriyama et al. | 219/216 |
| 5,793,399 | A | 8/1998 | Kawakami et al. | 347/104 |
| 5,867,196 | A | 2/1999 | Kiyohara et al. | 347/104 |
| 5,886,729 | A | 3/1999 | Hiramatsu et al. | 347/264 |
| 5,899,451 | A | 5/1999 | Kiyohara et al. | 271/167 |
| 5,992,993 | A | 11/1999 | Kiyohara et al. | 347/104 |
| 6,045,220 | A | 4/2000 | Kiyohara et al. | 347/104 |
| 6,095,515 | A | 8/2000 | Kiyohara et al. | 271/161 |
| 6,131,899 | A | 10/2000 | Nojima et al. | 271/121 |
| 6,151,462 | A | 11/2000 | Fukuzawa et al. | 399/67 |
| 6,173,151 | B1 * | 1/2001 | Ream et al. | 399/324 |
| 6,200,043 | B1 | 3/2001 | Inoue et al. | 400/88 |
| 6,250,827 | B1 | 6/2001 | Nojima et al. | 400/691 |
| 6,654,133 | B2 | 11/2003 | Inoue et al. | 358/1.12 |
| 6,915,099 | B2 | 7/2005 | Izawa et al. | 399/328 |
| 2005/0035536 | A1 | 2/2005 | Suga et al. | 271/226 |
| 2005/0185994 | A1 | 8/2005 | Inada et al. | 399/328 |
| 2005/0280682 | A1 | 12/2005 | Kato et al. | 347/102 |
| 2006/0000819 | A1 | 1/2006 | Makihira et al. | 219/216 |
| 2006/0017214 | A1 | 1/2006 | Inoue | 271/10.12 |

(Continued)

FOREIGN PATENT DOCUMENTS

| | | | |
|---|---|---|---|
| JP | 59157672 A | * | 9/1984 |
| JP | 59157673 A | * | 9/1984 |
| JP | 59157674 A | * | 9/1984 |
| JP | 59157675 A | * | 9/1984 |
| JP | 4-44075 | | 2/1992 |

(Continued)

*Primary Examiner*—Quana Grainger
(74) *Attorney, Agent, or Firm*—Fitzpatrick, Cella, Harper & Scinto

(57) ABSTRACT

The image heating apparatus for heating a toner image formed on a recording material, includes a rotatable member, a pressure roller which contacts with the rotatable member, wherein the recording material is heated while being conveyed by a nip portion between the rotatable member and the pressure roller, a charge eliminating member for eliminating a charge on a surface of said pressure roller, the charge eliminating member being grounded, wherein the pressure roller includes an electrically insulating elastic layer and an electrically insulating releasing layer. Thus the image heating apparatus can suppress a toner offsetting even in a high-speed heating process.

13 Claims, 15 Drawing Sheets

U.S. PATENT DOCUMENTS

| | | | | |
|---|---|---|---|---|
| 2006/0045589 | A1 | 3/2006 | Iwasaki et al. | 399/328 |
| 2006/0067750 | A1 | 3/2006 | Inoue et al. | 399/328 |
| 2006/0188280 | A1 | 8/2006 | Hayakawa et al. | 399/68 |

FOREIGN PATENT DOCUMENTS

| | | |
|---|---|---|
| JP | 7-319308 | 12/1995 |
| JP | 2675886 | 7/1997 |
| JP | 9-274343 | 10/1997 |
| JP | 2002-244472 | 8/2002 |
| JP | 2002-296854 | 10/2002 |
| JP | 2003-76183 | 3/2003 |
| JP | 2003-295646 | 10/2003 |
| JP | 2003-330297 | 11/2003 |
| JP | 2004-85978 | 3/2004 |
| JP | 2004-109175 | 4/2004 |

* cited by examiner

IMAGE HEATING APPARATUS WITH DISCHARGE OCCURRING BETWEEN A CHARGE ELIMINATING MEMBER AND A PRESSURE ROLLER

BACKGROUND OF THE INVENTION

1. Field of the Invention

The present invention relates to an image heating apparatus, adapted for use as a fixing apparatus to be incorporated in an image forming apparatus for example of electrophotographic process such as a copying apparatus or a printer.

2. Related Background Art

In an image forming apparatus utilizing an electrophotographic process, such as a printer, a copying apparatus or a facsimile apparatus, there is widely known, for fixing an unfixed toner image formed on a recording material, a fixing apparatus of heat roller type utilizing contact heating of satisfactory heat efficiency and safety.

Also in recent years, from the standpoint of energy saving, attention is being paid to a fixing apparatus of film heating type, utilizing a heating through a fixing film of a low heat capacity, as a "quick starting" system of a higher heat transmission efficiency and a faster start-up of the apparatus in comparison with the fixing apparatus of heat roller type, and the fixing apparatus of such film heating type is proposed for example in Japanese Patent Application Laid-open No. H04-44075.

The fixing apparatus of film heating type includes a configuration of conveying a fixing film under a tension by means of an exclusive conveying roller and an idler roller, in cooperation with a pressure roller, and a configuration of driving a cylindrical fixing film by a conveying force of a pressure roller. The former configuration has an advantage of improving the conveying ability for the fixing film, while the latter has an advantage of simplifying the structure thereby realizing a fixing apparatus of a low cost.

As a specific example, FIG. 10 shows a schematic lateral cross-sectional view of a fixing apparatus of film heating type (hereinafter referred to as a film fixing device) of the latter configuration driven by the pressure roller.

A stay 101 is elongated in a direction perpendicular to the plane of the drawing, and, a lower longitudinal face fixedly supports a ceramic heater (heat member) 108 prepared by forming a resistance heat member on a ceramic substrate. A heat-resistant cylindrical fixing film 102, constituting a heating rotary member, is loosely fitted on the stay 101 supporting the heat member 108. An elastic pressure roller 104, formed by heat-resistant rubber and constituting a pressurizing rotary member, forms a fixing nip portion N with the heat member 108 of the stay 101, through the fixing film 102. The pressure roller 104 is rotated counterclockwise as indicated by an arrow by an unillustrated driving system, whereby the fixing film 102 is driven around the stay 101, with an internal surface in a sliding motion in contact with the surface of the heat member 108 at the fixing nip portion N. A recording material P bearing an unfixed toner image T is introduced into the fixing nip portion N and is pinched and conveyed therein. Thus, the unfixed toner image T is fixed as a permanent image Ta on the recording material by a heat provided from the heat member 108 trough the fixing film 102 in the fixing nip portion N, and a pressure of the fixing nip portion N. The recording material emerging from the fixing nip portion N is further conveyed by discharge rollers 113 for discharging. For an appropriate temperature control of the heat member 108, a thermistor 107 for measuring the temperature of the heat member 108 is provided thereon. An arrowed direction with symbol "X" indicates a conveying direction of the recording material.

Together with the recent advancement in the computer industry, the printers are showing an increasing demand and are being used worldwide. As a result, there results a diversification of the recording material P in the type, thickness and surface of paper and also there are required a shorter first print time and a secure fixing property on the first print for responding to an increasing speed of the image forming apparatus, but a satisfactory fixing property has been attained by employing a higher fixing temperature or an improved thermal conductivity of the fixing film, thereby gradually increasing an instantaneous heat amount provided from the heat member to the recording material. Also in response to a requirement for a higher image quality of the user, printers with excellent dot reproducibility and gradation are being commercialized, and a higher image quality is also attained by employing a smaller toner particle size.

Under the aforementioned situation, various image defects may be generated also in a fixing step of the image forming process, but such defects have been avoided by various configurations.

One of such image defects is a toner offsetting. The offset means a phenomenon in which, when the recording material P bearing an unfixed toner image T passes through the fixing nip portion N, a part of the unfixed toner image T on the recording material P sticks onto the fixing film 102 serving as the heating rotary member and is re-transferred onto the recording material when the fixing film 102 after a turn comes into contact again with the recording material P thereby being fixed as a ghost image on the recording material.

The offset phenomenon includes one generated by a temperature factor and one generated by an electrostatic factor. The offset phenomenon generated by the temperature factor can be resolved by a temperature optimization, but that generated by the electrostatic factor is difficult to resolve.

In the following, there will be explained a mechanism of such offset phenomenon generated by an electrostatic charge (hereinafter referred to as electrostatic offset). When the recording material P enters the fixing nip portion N as schematically shown in FIG. 13 and in case the fixing film 102 is charged in a polarity opposite to the charging polarity of the toner constituting the unfixed toner image T and the surface of the pressure roller 104 is charged in a polarity same as the charging polarity of the toner constituting the unfixed toner image T, an electric field E1 in a direction indicated by arrows is generated in immediate front of the fixing nip portion, thereby exerting a force of separating a part of the toner of the unfixed toner image T from the recording material P. FIG. 13 shows, as an example, a case where the toner is charged negatively. Thus, a part of the unfixed toner image T on the recording material P loses a holding power thereon and is electrostatically deposited onto the fixing film 102. Such toner deposited on the fixing film 102 is, after a turn of the fixing film 102, re-transferred and then fixed on the recording material P as described above. Therefore, as schematically shown in FIG. 14, an offset pattern Ta', formed as a ghost image of a normal image pattern Ta and at a behind position, corresponding to a turn of the fixing film, in the conveying direction of the recording material P, is formed on the recording material P.

For solving such electrostatic offset, Japanese Patent No. 2675886 proposes, in a fixing apparatus for fixing a toner image by pinching and conveying a recording material bearing an unfixed toner image between a pair of moving members, a configuration of applying a bias voltage to a moving member and grounding the other moving member or applying a bias voltage through a rectifying element. In the configuration disclosed in Japanese Patent No. 2675886, a conductive material is blended in an elastic layer of the pressure roller to reduce a resistance thereof, whereby an eventual charge on the surface of the pressure roller is dissipated through a metal core to the ground whereby the charging on the pressure roller can be suppressed.

Another image defect is a trailing phenomenon or a smear of the toner image.

When a recording material P enters the fixing nip portion N of a film fixing device, there may result a phenomenon that a part of the unfixed toner image T on the recording material P is scattered in a stripe shape toward a rear direction in the conveying direction X of the recording material. Such phenomenon is called a trailing or a smear.

Such trailing is a phenomenon in which, when the recording material P enters the fixing nip portion N as schematically shown in FIG. 11, a part T0 of the unfixed toner image T on the recording material P is scattered rearward in the conveying direction of the recording material, then shifted as T1 and heat fixed in the fixing nip portion N, thereby forming a scattered image as shown in FIG. 12, in which Ta indicates a fixed image of the unfixed toner image T and T1' indicates a trailing portion formed by the aforementioned toner scattering.

The aforementioned tailing T1' is assumed to be caused by water vapor, which is generated by an abrupt heating of moisture, contained in the recording material P, in the fixing nip portion N. Thus generated water vapor tends to escape in a direction indicated by a broken-lined arrow Y in FIG. 11, and blows off a part T0 of the unfixed toner image T on the recording material P, thereby causing such phenomenon.

Also an increase in the heat amount supplied for fixing for achieving a higher speed of the apparatus elevates the temperature of the fixing nip portion N. In such case the water vapor is generated in a larger amount and more strongly blows off the part T0 of the unfixed toner image T thereby facilitating the generation of the trailing T1'.

As the water vapor tends to escape in a direction opposite to the conveying direction a of the recording material P, the scattering phenomenon at the fixation is conspicuous in a lateral line image and also in case the line has a large width with a larger deposition amount of the toner on the recording material.

FIG. 15 schematically shows a configuration having countermeasures against the toner image offsetting and the toner image trailing in the film fixing device shown in FIG. 10. A metal core 104*a* of the pressure roller 104 is grounded through a rectifying element 112 and a power source 1 thereby preventing an accumulation of a charge of a polarity same as that of the toner, and a voltage of a polarity opposite to that of the toner is applied to the metal core 104*a* of the pressure roller 104 thereby injecting a charge of a polarity opposite to that of the toner to the surface of the pressure roller. Also a voltage of a polarity same as that of the toner is applied to the fixing film 102, from a power supply 2 through a feeding member 111. Such voltage applications exert, immediately in front of the fixing nip portion N, a force for holding the unfixed toner on the recording material P. Such force prevents generation of both the trailing and the electrostatic offset, particularly for the latter. Also the fixing discharge rollers 113 are formed by conductive members and grounded, whereby, when the recording material is pinched both by the fixing nip portion N and by the nip of the fixing discharge rollers 113, there is formed a conductive path of fixing film surface—recording material P—fixing discharge rollers 113. The voltage applied to the fixing film 102 induces a current from the fixing film surface to the fixing discharge rollers 113, and an electric field induced by such current exerts a toner supporting force, thereby principally suppressing the trailing phenomenon.

The prior technology explained in the foregoing sufficiently meets the requirements in the past, but a further improvement of performance is requested for the recent image forming apparatus of a higher speed.

For example, the film fixing device of the configuration shown in FIG. 15 in an actual image output operation (hereinafter referred to as printing) provided a satisfactory image without a trailing or an electrostatic offset in a low-speed range with a recording material conveying speed (hereinafter also referred to as a process speed) of 100 mm/sec or less. However, in a printing with a plain paper of a basis weight of 75 g/m$^2$ in a speed range of a process speed of 150 mm/sec or higher, an image pattern offsetting may be generated within a width of 35 mm in a leading end portion of the recording material, and such offset became more conspicuous at a process speed of 200 mm/sec or higher.

In the configurations disclosed in Japanese Patent No. 2675886 and shown in FIG. 15, a conductive material is blended in the elastic layer of the pressure roller to reduce the resistance thereof, whereby an eventual charge on the surface of the pressure roller is dissipated through the metal core to the ground whereby the charging on the pressure roller is suppressed to prevent the electrostatic offset.

On the other hand, Japanese Patent Application Laid-open No. 2004-109175 proposes to suppress the electrostatic offset by a charge elimination of the surface of the pressure roller by a charge eliminating member.

However, it is found that the configuration of Japanese Patent Application Laid-open No. 2004-109175, despite of the presence of the charge eliminating member, cannot provide a sufficient charge eliminating effect, thus being unable to sufficiently suppress the electrostatic offset phenomenon.

SUMMARY OF THE INVENTION

The present invention has been made in consideration of the aforementioned problems, and an object thereof is to provide an image heating apparatus capable of suppressing a toner offsetting.

Another object of the present invention is to provide an image heating apparatus capable of suppressing a toner offsetting even in a high-speed heating process for the recording material.

A further object of the present invention is to provide an image heating apparatus capable of suppressing a toner offsetting and a toner trailing phenomenon.

A further object of the present invention is to provide an image heating apparatus including a rotatable member, a pressure roller in contact with the rotatable member, wherein a recording material is heated while being conveyed by a nip portion between the rotatable member and the pressure roller; and a charge eliminating member for eliminating a charge on the surface of the pressure roller, the charge eliminating member being grounded;

wherein the pressure roller includes an electrically insulating elastic layer and an electrically insulating releasing layer.

A still further objects of the present invention will become fully apparent from the following detailed description, which is to be taken in conjunction with the accompanying drawings.

DETAILED DESCRIPTION OF THE PREFERRED EMBODIMENTS

Embodiment 1

(1) Example of Image Forming Apparatus

Figure 2:
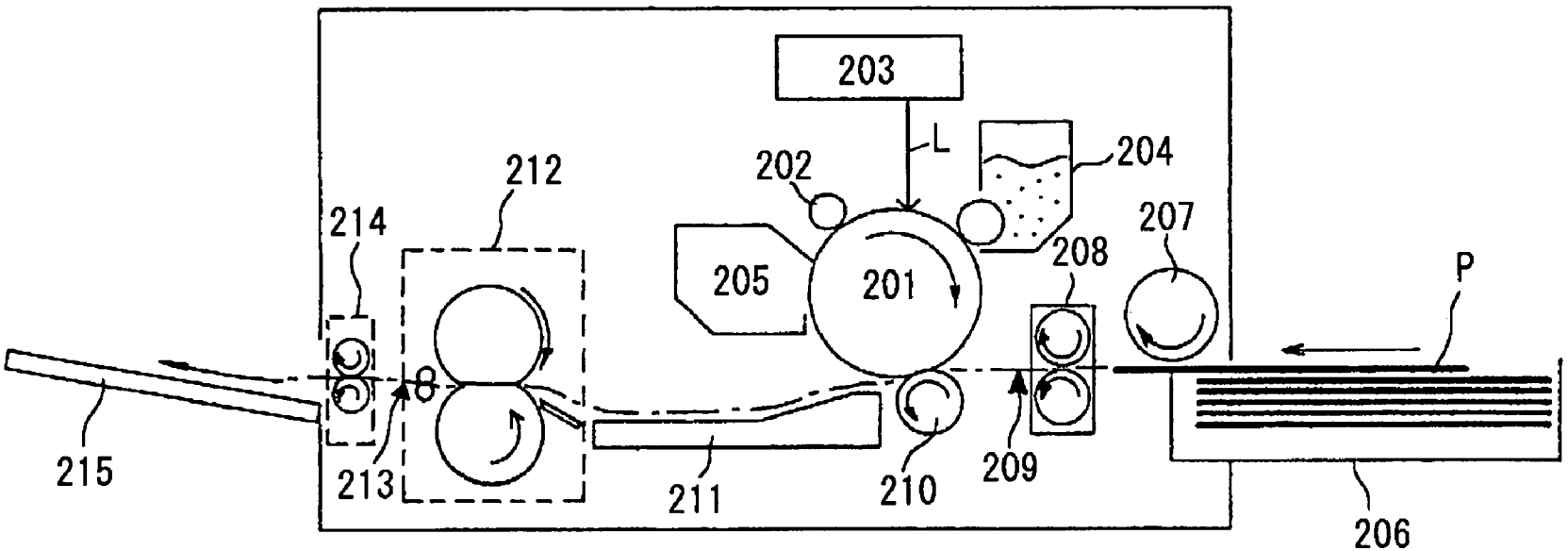
FIG. 2 is a schematic cross-sectional view showing a configuration of an image forming apparatus constituting an embodiment 1.

FIG. 2 is a schematic cross-sectional view showing a configuration of an image forming apparatus, which is a laser beam printer utilizing an electrophotographic process of transfer type.

An electrophotographic photosensitive member 201 of drum shape (hereinafter referred to as photosensitive drum) serves as an image bearing member, and is rotated clockwise, as indicated by an arrow, with a predetermined speed (process speed). A charging roller 202 serves as charging means and uniformly charges the surface of the photosensitive drum with predetermined polarity and potential. In the printer of the present embodiment, uniform charging is executed at predetermined negative potential. A laser scanner 203, serving as an image exposure apparatus, emits a laser light L, modulated corresponding to a time-sequential digital pixel signal of image information entered from an external device (host equipment) such as an image reader (not shown) or a computer, thereby scan exposing the uniformly charged surface of the photosensitive drum 201. Such scan exposure attenuates or eliminates the charge in an exposed portion on the photosensitive drum, thereby forming an electrostatic latent image corresponding to the image information.

A developing apparatus 204 develops the electrostatic latent image formed on the photosensitive drum into a visible toner image. In case of a laser beam printer, there is generally employed a reversal development in which the toner is deposited in an exposed light area of the electrostatic latent image. The printer of the present embodiment employs, for the developer, a negative toner having a negative charging polarity.

A sheet cassette 206 contains a stack of a recording material (transfer material) P such as paper. In response to a sheet feed start signal, a sheet feeding roller 207 is driven whereby the recording materials P in the sheet cassette 206 are separated and fed one by one. Thus fed recording material P is passed by registration rollers 208 and a top sensor 209 and is introduced, at a predetermined control timing, into a transfer portion formed by a contact nip portion of the photosensitive drum 201 and a transfer roller 210. A timing of conveying of the recording material P is controlled by the registration rollers 208 in such a manner that the leading end of the recording material P reaches the transfer position when a front end of the toner image on the photosensitive drum 201 reaches the transfer position, and a timing of image writing on the photosensitive drum 201 is controlled by a front end detection signal of the recording material by the top sensor 209.

The recording material P introduced into the transfer portion is pinched and conveyed therein, during which a transfer bias of a predetermined potential and a polarity opposite to that of the toner is given to a transfer roller 210 from an unillustrated transfer bias source, thereby providing a rear surface of the recording material P with a positive charge. Thus the toner image on the surface of the photosensitive drum is electrostatically transferred, at the transfer portion, in succession onto the recording material.

The recording material P, having received the transfer of the toner image at the transfer portion, is separated from the photosensitive drum, then conveyed along a conveying guide 211 and is introduced into a fixing apparatus 212, to be explained in detail in following (2), for heat fixing of the toner image. It is then discharged through a sheet discharge apparatus 214 to a discharge tray 215. A rear end sensor 213 for the recording material is provided behind a fixing nip portion of the fixing apparatus 212.

On the other hand, the surface of the photosensitive drum after the separation of the recording material (namely after the transfer of the toner image to the recording material) is subjected, by a cleaning apparatus 205, to an elimination of deposits such as a transfer residual toner and paper dusts, and is used again for image formation.

(2) Fixing Apparatus (Image Heating Apparatus) 212

Figure 1:
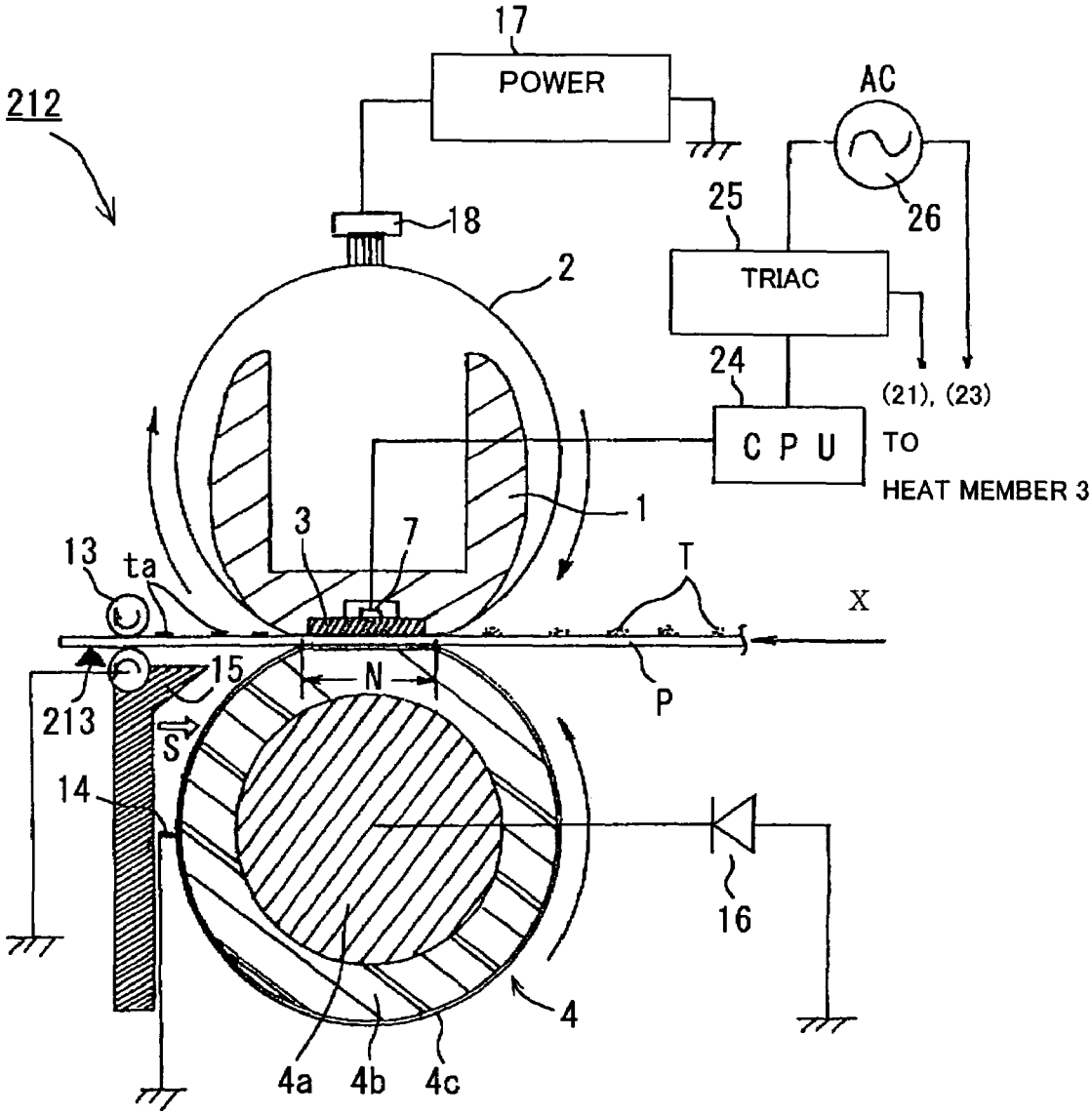
FIG. 1 is a schematic cross-sectional view showing a configuration of a film fixing device in an embodiment 1.
Figure 10:
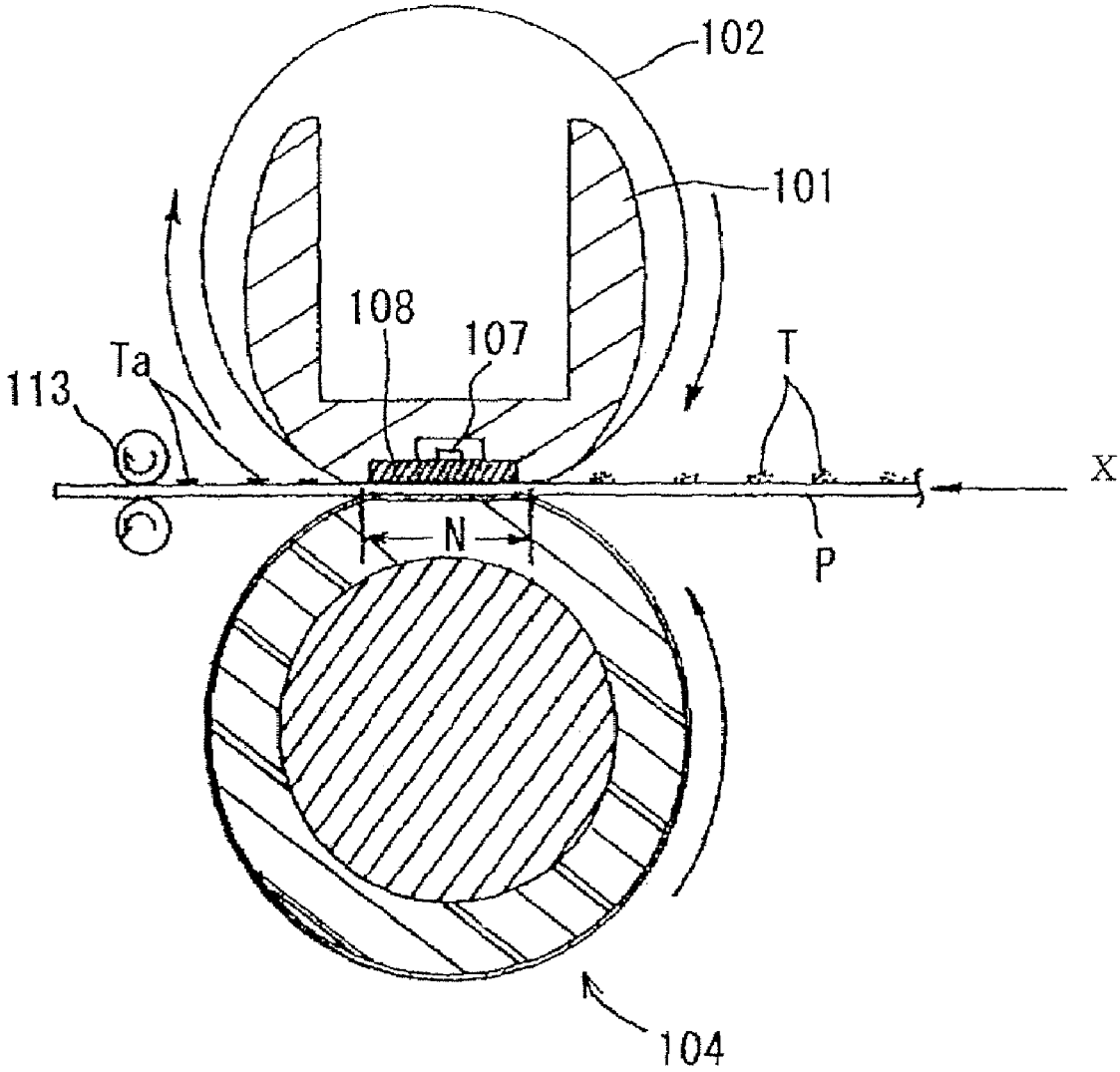
FIG. 10 PRIOR ART
FIG. 10 is a schematic cross-sectional view showing a configuration of a film fixing device in a prior technology.
Figure 11:
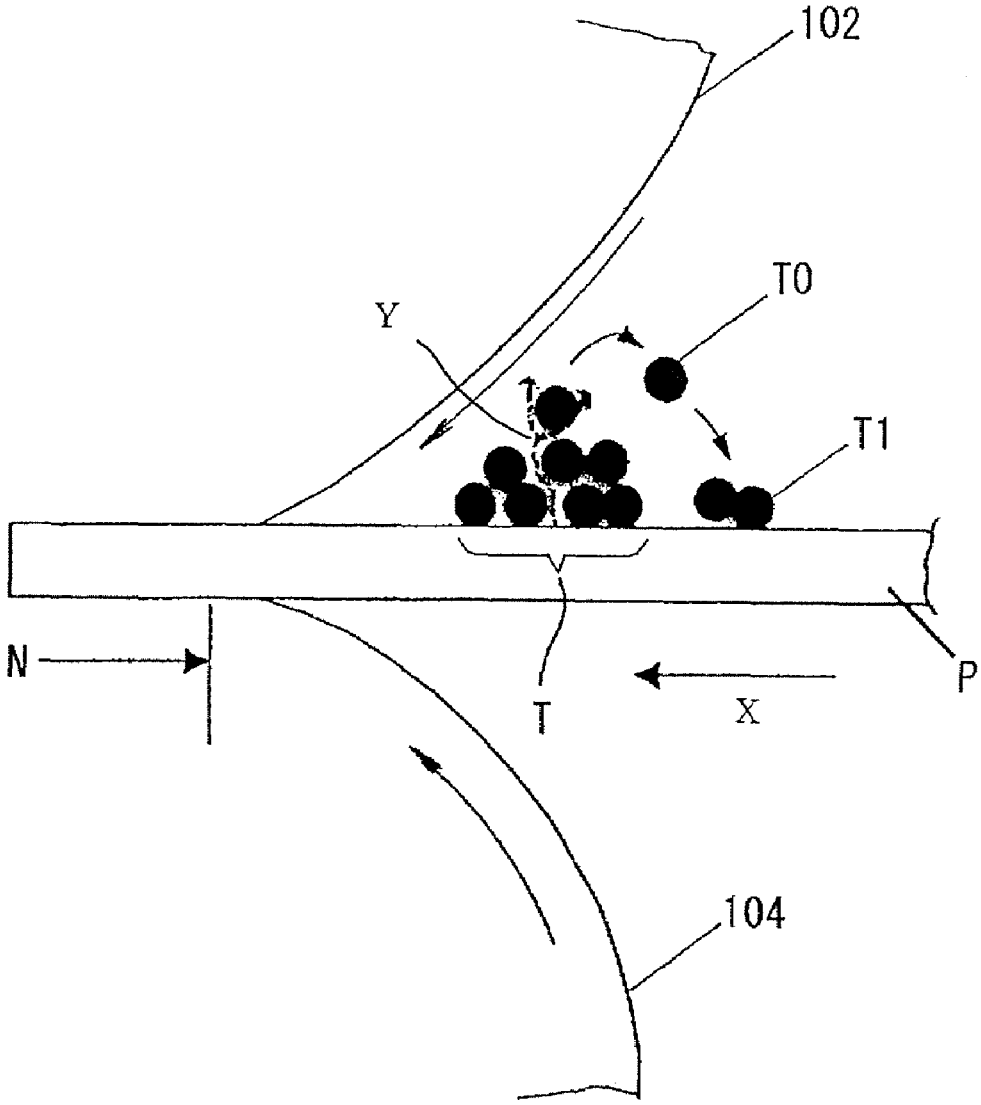
FIG. 11 PRIOR ART
FIG. 11 is a view showing a mechanism of trailing generation in a prior technology.
Figure 12:
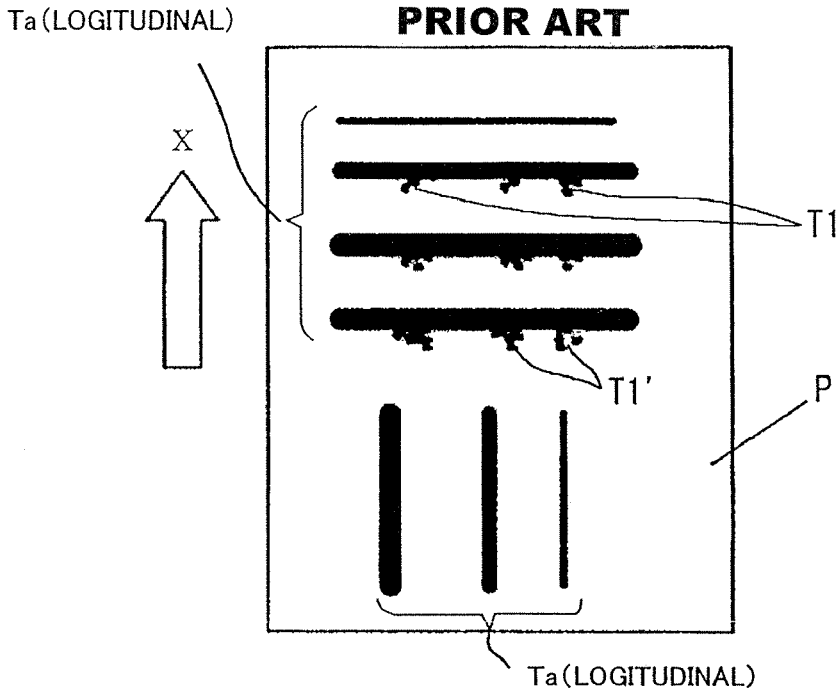
FIG. 12 PRIOR ART
FIG. 12 is a view showing a print image with a trailing in a prior technology.
Figure 13:
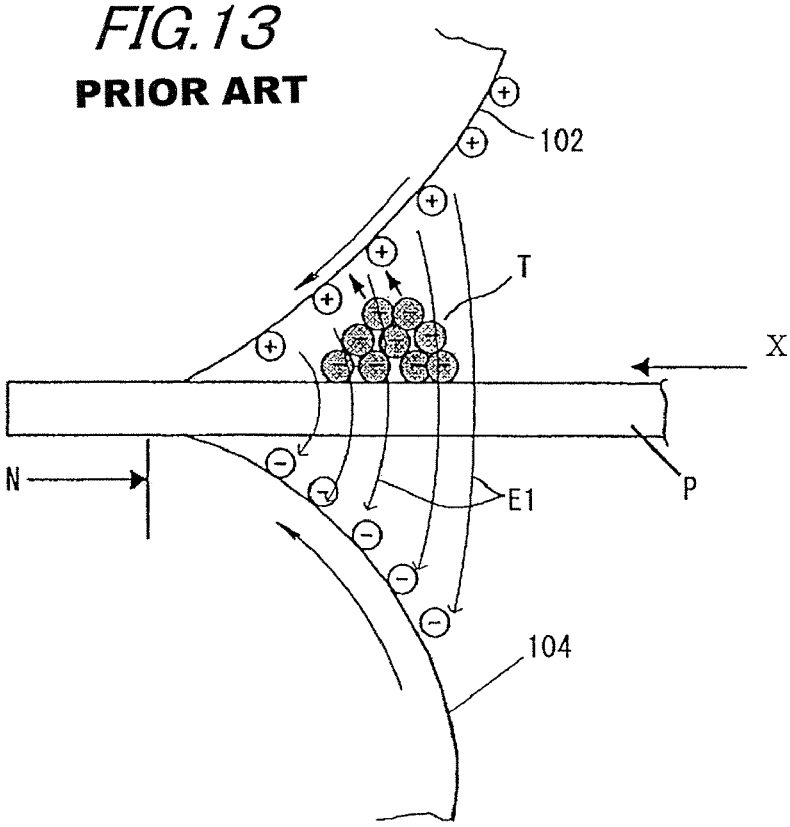
FIG. 13 PRIOR ART
FIG. 13 is a view showing a mechanism of electrostatic offset generation in a prior technology.
Figure 14:
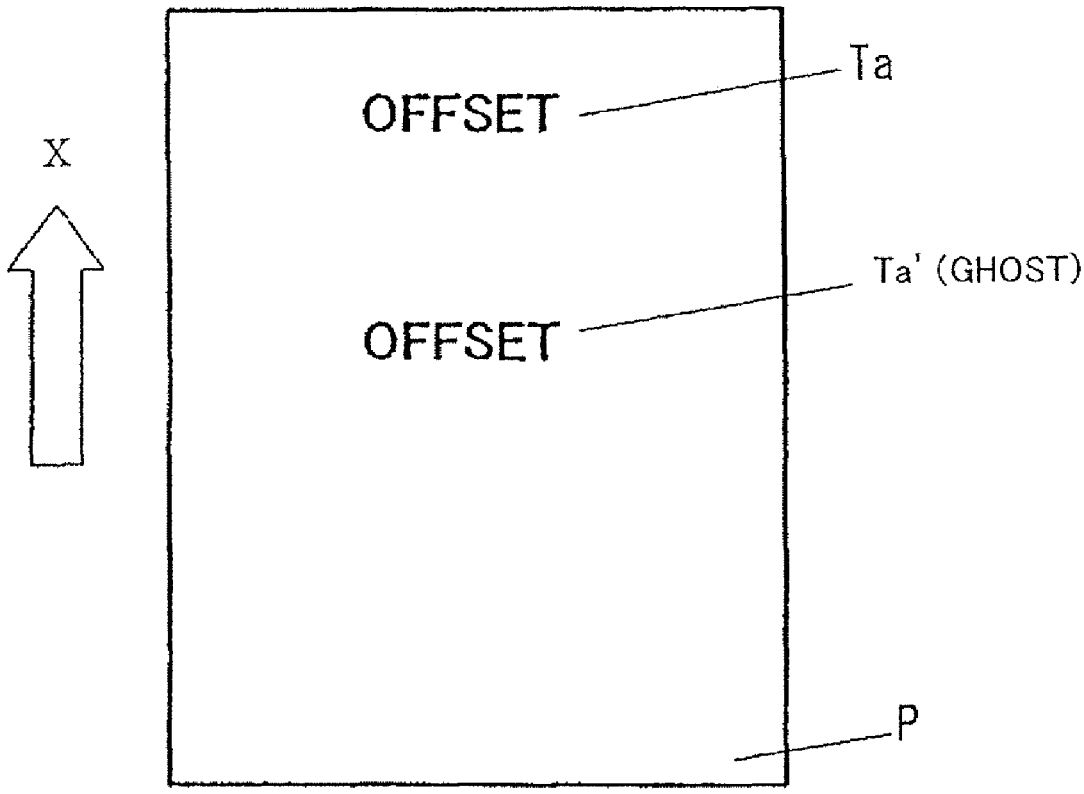
FIG. 14 PRIOR ART
FIG. 14 is a view showing a print image with an electrostatic offset in a prior technology.
Figure 15:
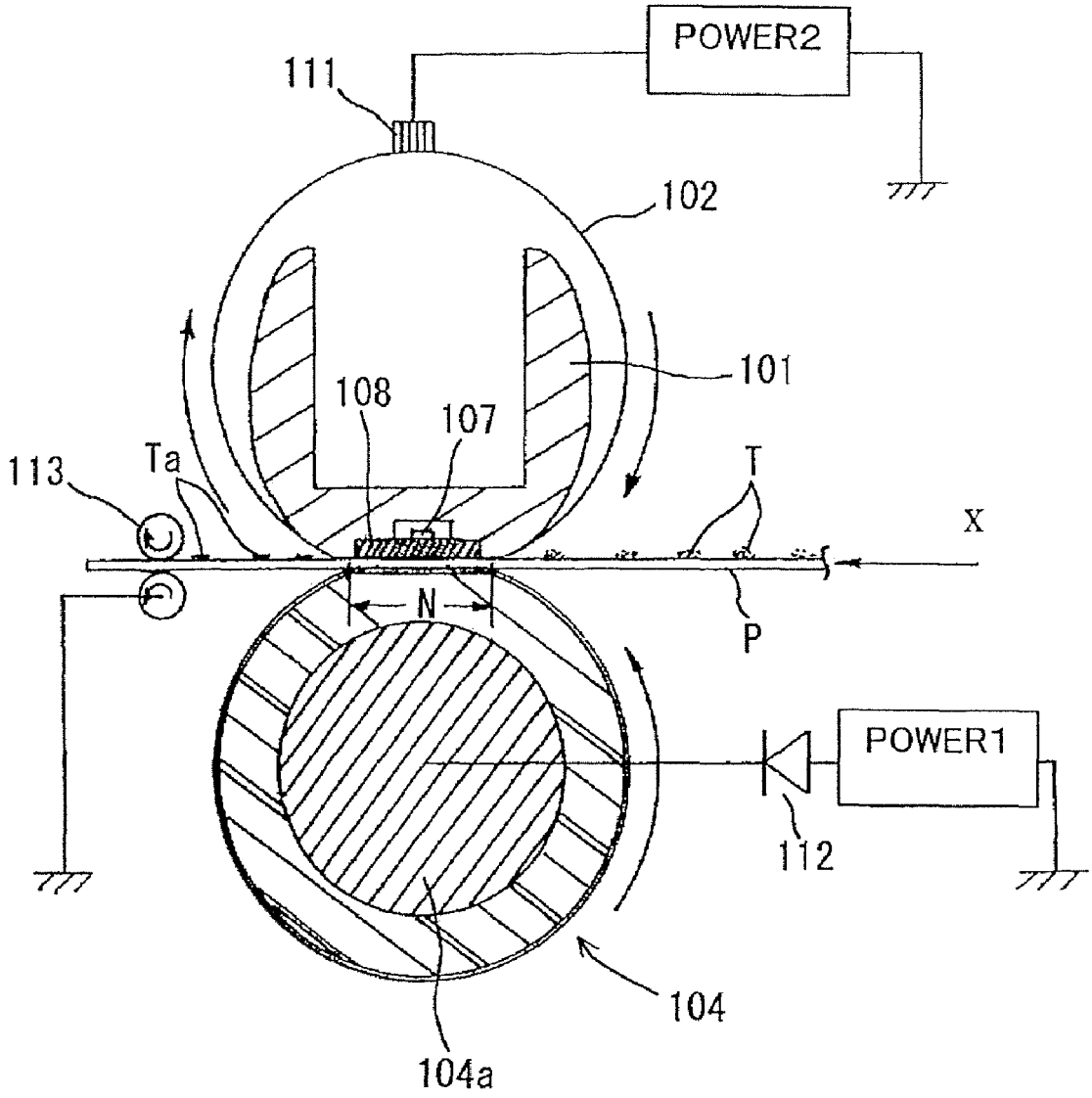
FIG. 15 PRIOR ART
FIG. 15 is a schematic cross-sectional view showing a configuration of a film fixing device (with applications of a film bias and a pressure roller bias) in a prior technology.

FIG. 1 is a schematic cross-sectional view of the fixing apparatus 212 in the present embodiment, which is a fixing apparatus of film heating type (film fixing device), driven by a pressure roller, as in the aforementioned fixing apparatus shown in FIG. 10.

The fixing apparatus is equipped with a heat-resistant rigid member constituting a stay 1 elongated in a direction perpendicular to the plane of the drawing and having functions of supporting a heat member and guiding a rotation of a fixing film. A lower longitudinal face of the stay 1 supports a ceramic heater (heat member) 3. A heat-resistant cylindrical fixing film 102 of a high thermal conductivity, constituting a heating rotary member, is fitted on the stay 1 including the heat member 3. A pressure roller 4, serving as a pressurizing rotary member having a margin in the peripheral length, is so positioned as to be opposed to the fixing film 2 along the direction of the fixing film 2 fitted outside the stay 1.

The stay 1 can be formed by a highly heat-resistant resin such as polyimide, polyamidimide, PEEK, PPS or a liquid crystal polymer, or a composite material thereof with ceramics, a metal or glass. A liquid crystal polymer is employed in the present embodiment.

The fixing film 2 can be a single-layered film of an excellent heat resistance such as PTFE, PFA or FEP or a composite-layer film which employs a seamless film of polyimide, polyamide or PPS as a base, and on which PTFE, PFA or FEP is coated. In order to reduce the heat capacity for improving a quick-starting property, the film preferably has a total thickness of about 100 μm or less, and optimally 30 to 80 μm.

Figure 3:
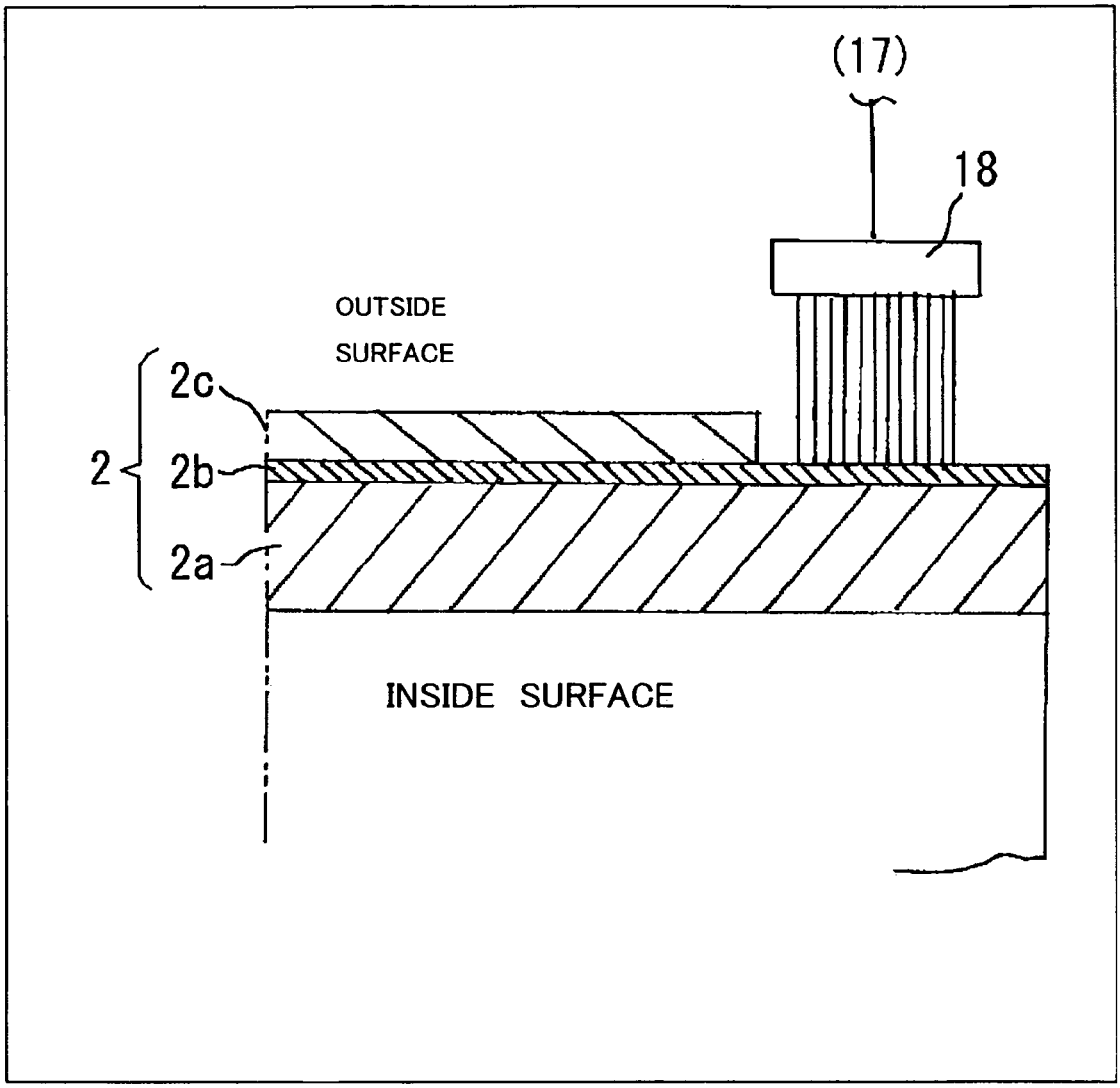
FIG. 3 is a schematic view showing a layer configuration of a fixing film.

The present embodiment employed, as the fixing film 2, of a film of a total thickness of 70 μm, formed, as indicated by a layer configuration shown in FIG. 3, by a polyimide base film 2*a* of an internal diameter of 24 mm, a thickness of 55 μm and a volume resistivity of $10\times10^{14}$ Ω·cm of which external surface was covered, through a primer layer (adhesive layer) 2*b* of a thickness of 5 μm and a surface resistivity of $10^{6}$ Ω/sq., with a tube of a thickness of 10 μm and a surface resistivity of $10^{10}$ Ω/sq. formed from PFA and PTFE blended with conductive carbon (hereinafter referred to as PFA tube) as a surface layer (releasing layer) 2. On the internal surfaced of the fixing film 2, grease is usually coated for improving the sliding property.

A ceramic heater 3 as a heat member will be explained later.

The pressure roller 4 is an elastic roller forming a fixing nip portion N with the heat member 3 through the fixing film 2 and serving contact drive means for the external surface of the film, for rotary driving the fixing film 2. The pressure roller 4 is constituted of a metal core 4*a*, an elastic layer 4*b* and an outermost releasing layer 4*c*, and is pressed, by bearing/biasing means (not shown), to the surface of the heat member 3 through the fixing film 2 under a predetermined pressure. The present embodiment employed an aluminum core as the metal core 4*a*, an insulating silicone rubber for the elastic layer 4*b*, and an insulating tube principally constituted of PFA as the releasing layer 4*c*. The pressure roller 4 had an external diameter of 25 mm, a thickness of the elastic layer 4*b* of 3.5 mm, and a thickness of the releasing layer 4*c* of 30 μm. A primer layer may be provided between the elastic layer 4*b* and the releasing layer 4*c*, in order to facilitate adhesion thereof. In such case, the primer layer is also preferably formed by an insulating material. Also the elastic layer 4*b* preferably has a volume resistivity of $10^{12}$ Ω·cm or higher, and the releasing layer 4*c* preferably has a volume resistivity of $10^{16}$ Ω·cm or higher. A resistance from the elastic layer of the pressure roller to the releasing layer, namely between the metal core 4*a* and the surface of the pressure roller, is preferably $10^{16}$ Ω or higher.

Figure 16:
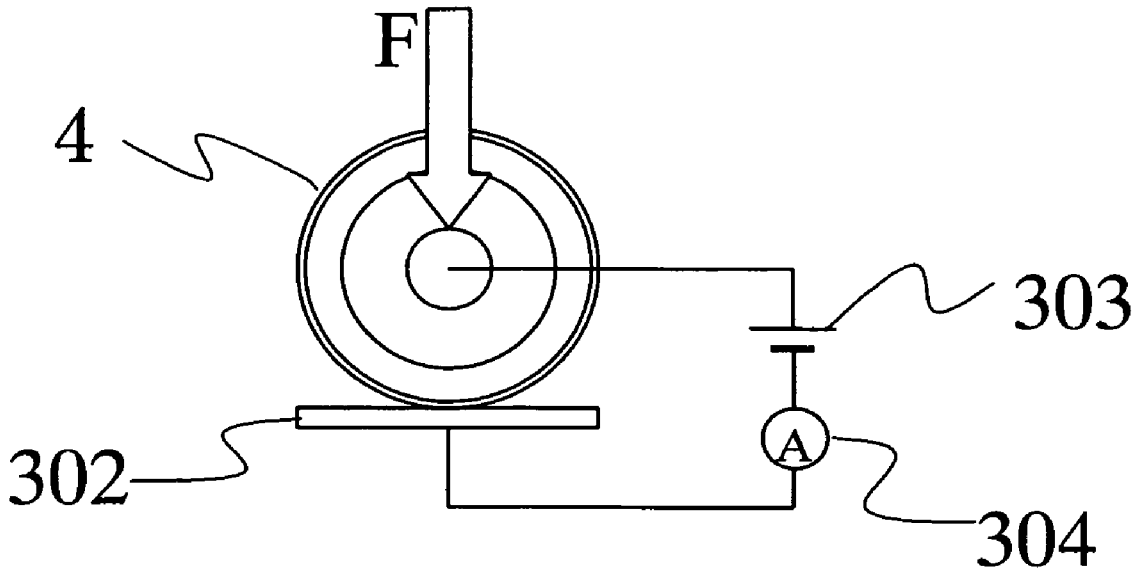
FIG. 16 is a view showing a method for measuring a resistance of the pressure roller.

A method of measuring the electrical resistance of the pressure roller is shown in FIG. 16.

In FIG. 16, there are shown a stainless steel plate 302, a power source 303 and an ammeter 304. The pressure roller 4 has a diameter of 25 mm and a longitudinal length of 230 mm in the outermost portion. The metal plate 302 has a thickness of 5 mm, a width of 20 mm and a length of 300 mm. The pressure roller 4 is contacted with the metal plate 302 under a force F of 15 kgf.

In this state, the pressure roller and the metal plate are contacted with a width of 7 mm in a direction perpendicular to the axial direction of the pressure roller. A voltage of +500 V is applied by the power source 303 to the metal core of the pressure roller 4.

Then a current flowing between the pressure roller and the metal plate is measured with the ammeter 304.

The resistance of the pressure roller is calculated by resistance=500 V/I, in which I indicates a current (amperes) measured in this state.

The pressure roller of the present embodiment, measured in such method, showed a resistance (between the metal core 4*a* and the surface of the pressure roller) was $10^{16}$ Ω.

The pressure roller 4 is driven counterclockwise, as indicated by an arrow, by an unillustrated driving system with a predetermined peripheral speed. By the rotation of the pressure roller 4, the fixing film 2 is rotated by a frictional force between the pressure roller 4 and the external surface of the fixing film in the fixing nip portion. Therefore, the fixing film 2 enters, with the internal periphery thereof in contact with and sliding over the heat member 3 in the fixing nip portion N, a driven state rotating clockwise about the stay 1 with a peripheral speed substantially same as the peripheral speed of the pressure roller 4. The stay 1 also serves as a guide member for thus rotated fixing film 2.

Then, in a state where the heat member 3 is heated to a predetermined temperature and the rotational peripheral speed of the fixing film by the rotation of the pressure roller 4 is made stable, the recording material P to be subjected to an image fixation is introduced between the fixing film 2 and the pressure roller 4 in the fixing nip portion N. Then the recording material P is conveyed together with the fixing film in the fixing nip portion N whereby the heat of the heat member 3 is given to the recording material P through the fixing film 2 and the unfixed toner image T on the recording material P is heat fixed as Ta onto the recording material P.

After passing the fixing nip portion N, the recording material P is separated from the film 2, then relayed by fixing discharge rollers 13 and discharged.

Figures 4A, 4B, 4C:
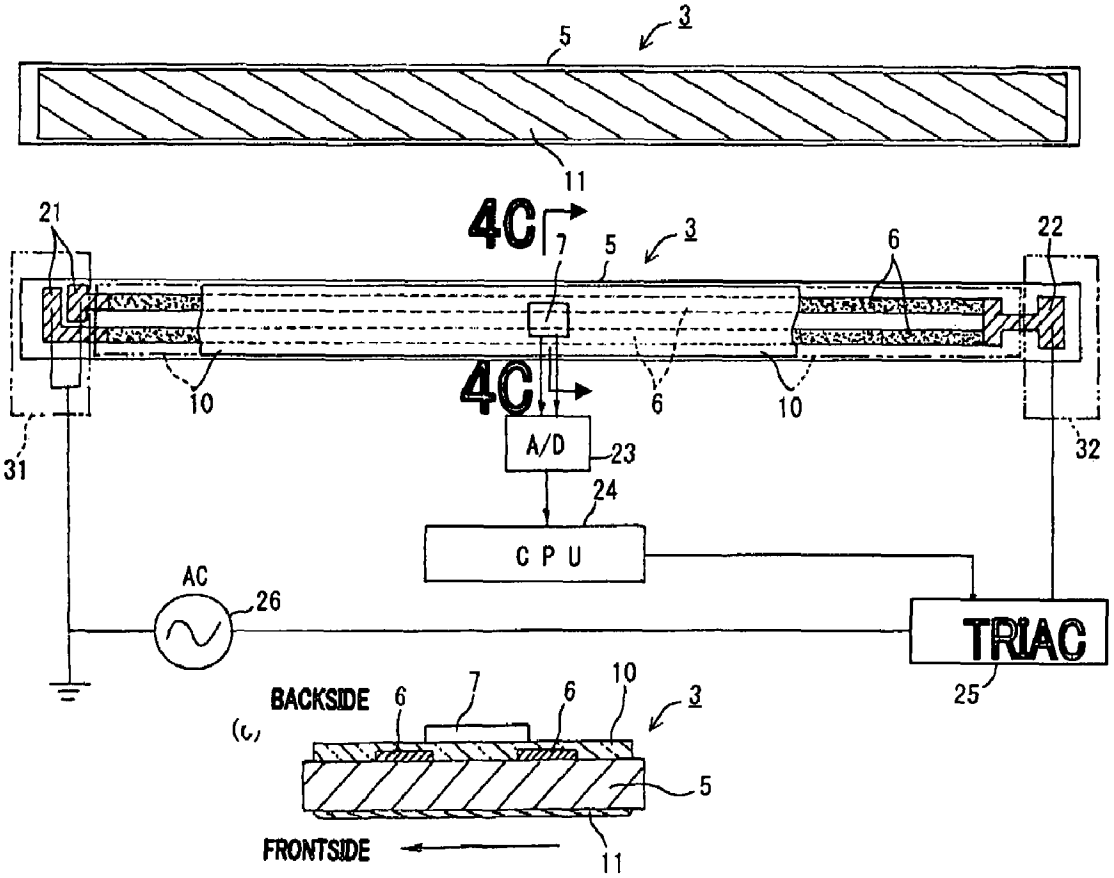
FIG. 4A is a schematic plan view of a top side that corresponds to a sliding surface of a fixing film which contact with a heat member 3.
FIG. 4B is a partially cut-off schematic plan view of a rear side which corresponds to a non-sliding surface of a fixing film which does not contact with a heat member 3 and a block circuit diagram of a power supply system.
FIG. 4C is a magnified schematic cross-sectional view along a line 4C-4C in FIG. 4B.

The heat member 3 has an oblong shape elongated in a direction perpendicular to the conveying direction a of the recording material P. FIGS. 4A to 4C show configuration of the heat member 3 in the present embodiment. FIG. 4A is a schematic plan view of a top side (in sliding contact with a fixing film) of a heat member 3. FIG. 4B is a partially cut-off schematic plan view of a rear side (not in sliding contact with the fixing film) and a block circuit diagram of a power supply system. FIG. 4C is a magnified schematic cross-sectional view along a line 4C-4C in FIG. 4B.

In the present embodiment, the heat member 3 has a structure of heat generation on the rear face, employing aluminum nitride as a substrate.

A heat member substrate (heater substrate) 5 is constituted of an aluminum nitride substrate having a heat resistance, an insulating property and a high thermal conductivity. For reducing the heat capacity, there is employed a substrate of a thickness of 0.6 mm, a width of 10 mm and a length of 300 mm. On a top surface side (to be in sliding contact with the fixing film) of the heat member substrate 5, there is provided a sliding layer 11, which is excellent in heat resistance and abrasion resistance and ensures a smooth sliding of the fixing film 2. The present embodiment employed a heat-resistant glass of a thickness of 50 μm.

A resistance heat member 6, positioned between the heat member substrate (heater substrate) 5 and the sliding layer 11, is formed by coating an electrical resistance material such as Ag/Pd (silver-palladium), $RuO_2$ or $Ta_2N$ by screen printing or the like on the rear side (not in sliding contact with the fixing film) of the heat member substrate 5 along a longitudinal direction thereof. In the present embodiment, there were employed two stripes formed by screen printing a mixture of Ag/Pd and glass with a thickness of about 10 μm, a width of 2 mm and a length of 225 mm. A desired resistance can be obtained by altering a composition ratio of Ag/Pd and glass. In the present embodiment, the resistance heat members had a synthesized resistance of 13 Ω at the normal temperature.

For power supply to the resistance heat member 6, there are provided power supply electrodes 21, 22, which are electrically connected to the resistance heat member 6 on both ends of the rear surface of the heat member substrate 5. In the present embodiment, the electrodes 21, 22 were formed by screen printed patterns of a mixture of Ag/Pd and glass.

On the rear side of the heat member substrate 5, a heat-resistant insulating overcoat layer 10 is provided to cover and protect the resistance heat member 6, thereby providing an insulation from external conductive members, an anticorrosion for preventing a change in resistance of the resistance heat member 6 for example by oxidation, and a prevention of mechanical damage. The present embodiment employed a heat-resistant glass of a thickness of about 50 μm.

At an approximate center of the longitudinal direction on the rear side of the heat member, a thermistor 8 as a temperature sensor is contacted.

The heat member 3 is fixed, with the rear side bearing the resistance heat member 6 upwards, on lower side of the stay 1.

The aforementioned configuration realizes a low heat capacity in the entire heat member in comparison with the heat roller type, thereby enabling a quick starting.

Power supply connectors 31, 32 are fitted on power supply electrodes 21, 22 on both ends of the heat member 3 fixed on the stay 1, whereby the electrical contacts of the connectors 31, 32 are connected to the electrodes 21, 22. The power supply connectors 31, 32 are connected through a power supply cable to a power supply unit.

A power supply form a commercial power source (AC power source) 26 to the electrodes 21, 22 through a triac 25 causes a heat generation of the resistance heat member 6, thereby realizing a rapid temperature rise in the entire effective length of the heat member 3. Then the temperature of the heat member 3 is detected by the thermistor 7, of which the output is supplied through an analog/digital (A/D) converter 23 to a power supply controller (CPU) 24. Based on the detected temperature information, the controller 24 executes a phase control or a wave number control on the triac 25 for an electric power supplied to the heat member 3, thereby achieving a temperature control thereof. More specifically, the electric power supplied to the heat member 3 is so controlled as to elevate the temperature of the heat member 3 in case the temperature detected by the thermistor 7 is lower than a preset temperature (fixing temperature), or to lower the temperature of the heat member 3 in case the temperature detected by the thermistor 7 is higher than the preset temperature, thereby keeping the heat member 3 at a predetermined constant temperature in the fixing operation. In the present embodiment, there was employed so-called on-off control of a power supply of 100% or 0% respectively in case the temperature detected by the thermistor 7 is lower or higher than the preset temperature.

Referring to FIG. 1, the fixing discharge rollers 13 are electro-conductive and are grounded. A power source 17 and a power supply conductive brush 18 are provided as bias applying means for the fixing film 2 constituting the heating rotary member. The conductive brush 18 is contacted, as shown in FIG. 3, with the primer layer **2*b* exposed longitudinally outside a print area of the fixing film 2. The power source 17 applies a voltage of a polarity same as that of the toner to the fixing film through the power supply conductive brush 18 and the primer layer 2*b*. More specifically, the power source 17 applies a voltage of −800 V to the fixing film, during a period, in FIG. 2, after the lapse of a predetermined time from the activation of the top sensor 209 for detecting the front end of the recording material to the detection of the rear end of the recording material by the rear end sensor 213** positioned behind the fixing nip.

Figure 5:
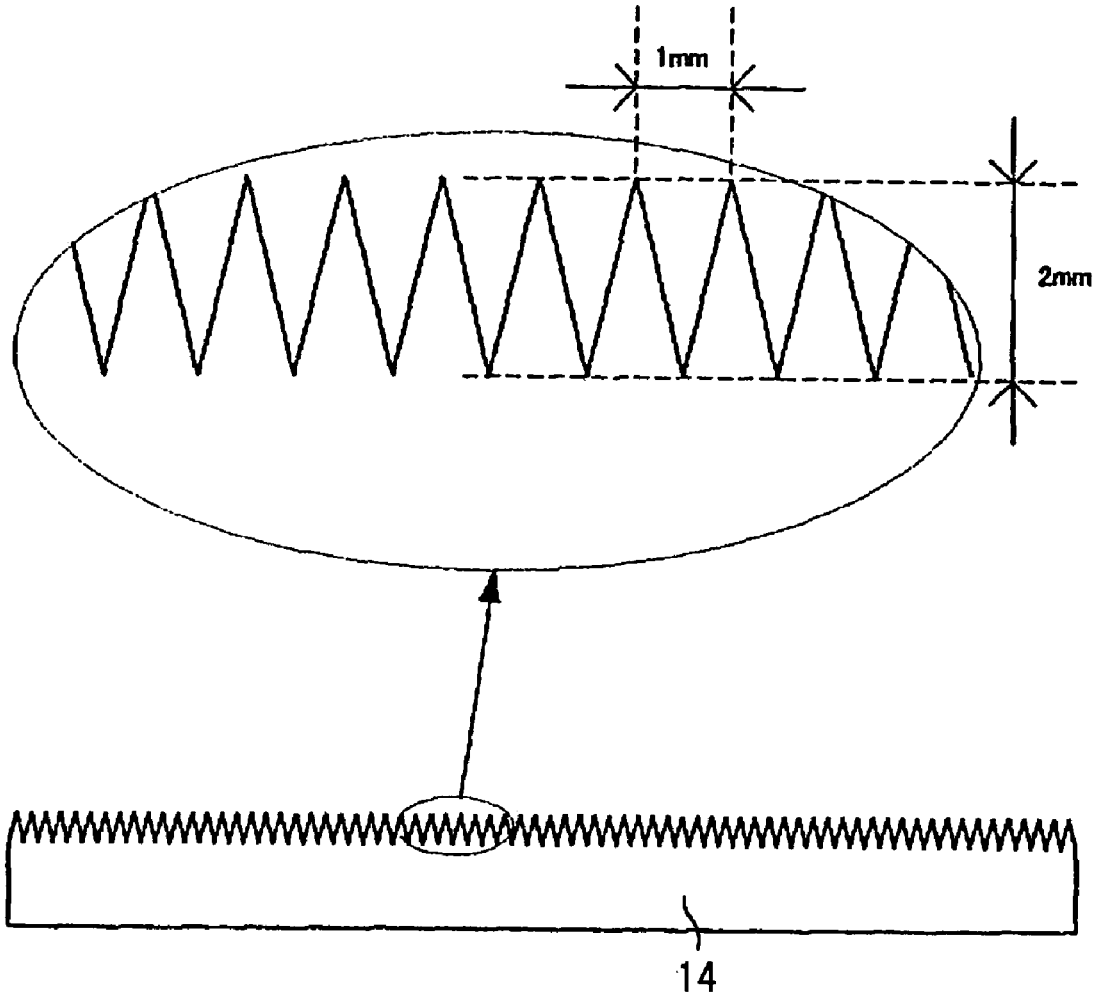
FIG. 5 is a schematic view of a charge eliminating needle.

In FIG. 1, there is provided a charge eliminating needle 14, constituting a charge eliminating member and provided in the vicinity of the pressure roller 14 in non-contact manner therewith. The charge eliminating needle 14 is formed by a metal plate such as of SUS (stainless steel), and is grounded. In consideration of the charge eliminating property, the charge eliminating needle preferably has a small thickness and a small distance between needle points. The present embodiment employed a SUS plate of a thickness of 0.1 mm, with a comb-shaped point of a height of 2 mm and a pitch of 1 mm as shown in a front view in FIG. 5. The charge eliminating needle has a length of 220 mm and is positioned parallel to the longitudinal direction of the pressure roller.

The charge eliminating ability of the charge eliminating needle 14 becomes larger or smaller as the distance between the points thereof and the surface of the pressure roller becomes respectively shorter or longer.

Silicone rubber employed in the elastic layer **4*b* of the pressure roller 4** shows a thermal expansion of 0.7 mm at maximum, during the operation of the fixing apparatus. Therefore, the distance between the point of the needle and the surface of the pressure roller has to be 0.7 mm or larger at the normal temperature. In case the distance between the point of the needle and the surface of the pressure roller is less than 0.7 mm at the normal temperature, the point of the needle may contact and damage the surface of the pressure roller during the operation of the fixing apparatus to cause an image defect or a deformation of the point of the needle, thereby losing the charge eliminating ability. It is also found that a distance between the point of the needle and the surface of the pressure roller exceeding 3 mm cannot exhibit the charge eliminating ability.

Therefore, the distance between the point of the needle and the surface of the pressure roller is preferably within a range of 0.7 to 3 mm. In the present embodiment, the charge eliminating needle 14 was positioned behind the fixing nip portion in such a manner that the distance between the point of the needle 14 and the surface of the pressure roller was 2 mm.

Also in the present embodiment, the aluminum core 4*a* of the pressure roller 4 is grounded through a rectifying element 16, thereby preventing accumulation of a change of a polarity same as that of the toner on the metal core 4*a*.

In the following, there will be explained function and effects of the present embodiment. In the process of the fixing apparatus 212 for permanently fixing the unfixed toner image T on the recording material P in the course of the image forming operation of the printer, the surface of the pressure roller 4 moves in a sliding contact with the surface of the fixing film or the rear surface of the recording material P. In this state, the insulating surface layer 4*c* of the pressure roller 4 is charged. The potential of such charging is determined by physical properties of the mutually sliding materials, and, in the present embodiment, the PFA tube 4*c* on the surface of the pressure roller is charged negatively, which is same as the charging polarity of the toner.

In the aforementioned configuration, in case of continuously passing plain paper sheets of a basis weight of 75 g/m$^2$ as recording materials P at a process speed of 200 mm/sec and a rate of 35 prints per minute (hereinafter referred to as 35 ppm), a charged potential on the surface of the pressure roller at a position S in FIG. 1, immediately behind the fixing nip, was measured by a surface potential meter (Model 346, manufactured by TREK Ltd., used with a probe MODE600B-8) and found as −2.5 to −3 kV (−3 kV being a limit of measurement of the used measuring instrument). In this state, a current flowing to the ground through the charge eliminating needle 14 was found as 0.1-1 μA.

It is thus found that the charge on the surface of the pressure roller 4 can be eliminated by the charge eliminating needle 14 by employing a pressure roller having an electrically insulating layer configuration except for the metal core 4*a*, namely in the elastic layer 4*b* and the releasing layer 4*c*.

Therefore, in the pressure roller in which the elastic layer 4*b* and the releasing layer 4*c* are both electrically insulating, the surface of the pressure roller maintained at a high potential is discharged to the charge eliminating needle 14 where by the pressure roller surface is maintained at a low potential.

In the following there will be explained trailing and electrostatic offset phenomena in the fixing apparatus of the present embodiment. In an image forming apparatus utilizing the fixing apparatus of the present embodiment, level of the trailing and electrostatic offset phenomena were confirmed on images printed at a process speed of 200 mm/sec.

A plain paper of a basis weight of 75 g/m$^2$ was used for evaluating the image, and the trailing was evaluated under an environment of a temperature of 23° C. and a relative humidity of 85%, and the offset was evaluated under an environment of a temperature of 15° C. and a relative humidity of 10%.

The trailing was evaluated with a lateral line pattern of 6 dots with 40 spaces (600 dpi), and the offset was evaluated with a pattern having alphabets within a leading width of 75 mm of the image.

As a result, a satisfactory image without trailing or offset was obtained.

In the present embodiment, when the distance between the surface of the pressure roller and the point of the charge eliminating needle was 2 mm, a discharge from the pressure roller 4 was initiated at a surface potential of about −2.5 kV.

In the vicinity of the fixing nip, because of the application of a voltage of −800 V to the fixing film 2, the surface of the fixing film becomes positive with respect to the surface of the pressure roller charged at a potential of −2.5 to −3 kV, and the surface of the pressure roller becomes negative. Such surface potential relationship facilitates the electrostatic offset according to the aforementioned mechanism for the offset. In the configuration of the present embodiment, however, the electrostatic offset phenomenon was not observed. Based on this experimental result, the electrostatic offset is considered to be governed and generated, rather than by the relative relationship of the surface potential of the pressure roller and that of the fixing film in the vicinity of the fixing nip, by a relative relationship of a charge amount on the surface of the pressure roller and a charge amount on the surface of the fixing film. The frictionally charged pressure roller 4 has a surface potential that is negatively larger than the surface potential of the fixing film 2. However, between the surface of the pressure roller and the grounded metal core 4*a*, there are provided a silicone rubber layer 4*b* of a thickness of 3.5 mm and an insulating releasing layer 4*c* of a thickness of 30 μm. Therefore, the pressure roller of the present embodiment has a very small electrostatic capacity between the metal core 4*a* and the surface of the pressure roller 4 because of the presence of the silicone rubber layer 4*b* and the releasing layer 4*c* which are both insulating. Therefore, a pressure roller, in which the silicone rubber layer 4*b* and the releasing layer 4*c* are both insulating as in the present embodiment, only holds a small charge amount though the frictional surface potential is considerably high.

Also in the present embodiment, the surface of the pressure roller is subjected to a charge elimination by the charge eliminating needle as explained above. In case of an insulating pressure roller as in the present embodiment, it has a high charge potential on the surface. In case of such high charge potential, a discharge to the charge eliminating needle is easily generated in comparison with a case of a low charge potential, so that the charge eliminating needle can provide a very high charge eliminating effect.

Figure 6:
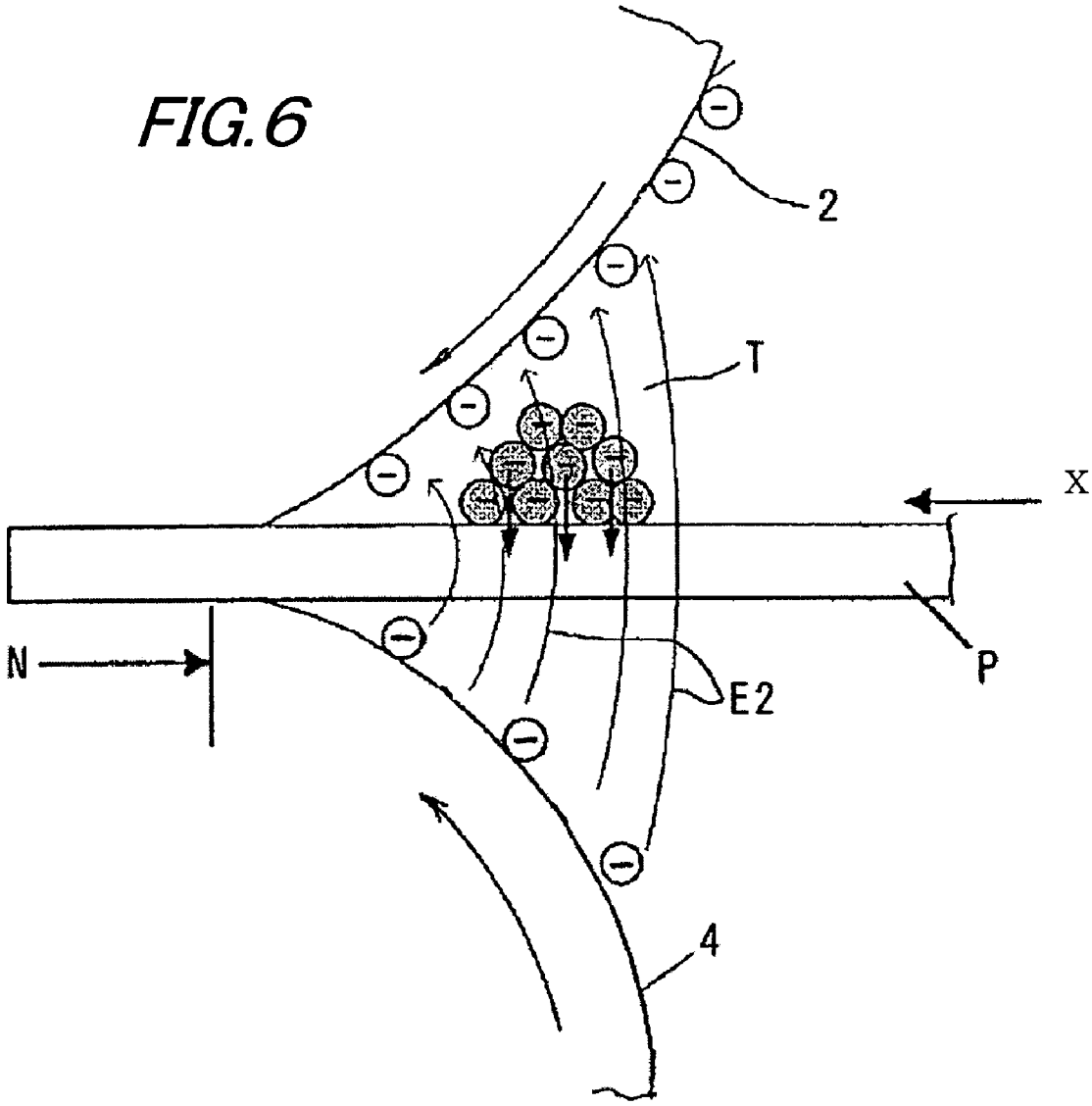
FIG. 6 is a view showing a mechanism of suppressing an electrostatic offset in the embodiment 1.

Thus, in a configuration of employing insulating layers between the metal core and the surface of the pressure roller and executing a charge elimination on the surface of the pressure roller, an actual negative charge amount present on the surface of the pressure roller is assumed to be less than the negative charge amount present on the surface of the fixing film. Therefore, such difference in the actual charge amounts renders the surface of the pressure roller relatively positive, whereby an electric field E2 directing toward the film surface is formed between the film surface and the surface of the pressure roller as shown in FIG. 6, and such electric field exerts a force of supporting the negatively charged unfixed toner on the recording material P, thereby suppressing the electrostatic offset phenomenon.

Also when a voltage is applied to the fixing film 2 and the recording material P is pinched by the conductive fixing discharge rollers 13, a conductive path is formed from the fixing film 2 to the fixing discharge rollers 13 through the surface of the recording material to induce a current, and an electric field induced by such current further attracts the toner to the recording material thereby further suppressing the trailing phenomenon as explained in the foregoing.

In the following, there will be explained a restriction on the electrical properties of the silicone rubber constituting the insulating elastic layer 4*b* of the pressure roller 4 in the present embodiment.

Following Table 1 shows the surface potential of the pressure roller 4 measured in different combinations of (1) cases where the fixing film 2 is given a bias or is kept in a floating state without the bias application, (2) cases where the elastic layer 4*b* of the pressure roller 4 is made insulating or conductive, and (3) cases where the surface of the pressure roller is not subjected to a charge elimination or is provided with the charge eliminating needle. The measurement was conducted at the aforementioned position S in FIG. 1, with the aforementioned measuring instrument. The releasing layer 4*c* was made insulating regardless whether the elastic layer 4*b* of the pressure roller 4 was insulating or conductive.

TABLE 1

| | | | surface | w/charge-eliminating needle | | w/o charge-eliminating needle | |
|---|---|---|---|---|---|---|---|
| | | film bias | potential | offset | trailing | offset | trailing |
| elastic layer of pressure roller | conductivity | Not Exsist | ca. −1.0 kV | present | present | present | present |
| | | Exsist | ca. −1.0 kV | present | absent | present | absent |
| | insulation | Not Exsist | ca. −2.6 kV | present | present | absent | present |
| | | Exsist | −3.0 kV | present | absent | absent | absent |

As shown in Table 1, when the elastic layer 4*b* of the pressure roller 4 is conductive, the surface potential of the pressure roller 4 measured at the position S in FIG. 1 is about −1 kV regardless whether the bias application to the film is present or absent, and the charged potential has a smaller absolute value in comparison with the case where the elastic layer 4*b* is insulating. This is presumably because the charge on the surface of the pressure roller is dissipated through the conductive elastic layer and the metal core 4*a* to the ground. As the actually measured surface potential fluctuated with a range of several hundred volts, Table 1 shows an average peak value in each case.

It is also shown that the offset is generated even in a configuration of providing a charge eliminating needle 14 with a pressure roller utilizing conductive silicone rubber in the elastic layer 4*b* (hereinafter referred to as conductive pressure roller). In such configuration, no current was measured through the charge eliminating needle 14 to the ground. This is presumably because the electrostatic capacity between the metal core and the pressure roller is large as the silicone rubber layer is conductive and the releasing layer alone is insulating. A large electrostatic capacity between the metal core and the surface of the pressure roller reduces the charged potential on the surface of the pressure roller to about −1.0 kV, thereby rendering discharge to the charge eliminating needle difficult and decreasing the charge eliminating effect.

Also a large electrostatic capacity between the metal core and the surface of the pressure roller increases the negative charge amount itself supported on the surface of the pressure roller thereby facilitating the electrostatic offset.

Therefore, in case of a conductive pressure roller, it is assumed that the negative charge amount itself supported on the surface of the pressure roller becomes larger and the charge eliminating needle if present provides only a limited charge eliminating effect, whereby the offset phenomenon is induced.

In the configuration utilizing the conductive pressure roller, the presence/absence of the trailing and the electrostatic offset were confirmed on the actually printed image as described above, and the results are shown in the right-hand columns of Table 1. As a result, in the configuration utilizing a conductive pressure roller, it is found that an application of fixing film bias can suppress the trailing but cannot suppress the electrostatic offset.

Also in a configuration employing a pressure roller with insulating silicone rubber in the elastic layer 4*b* (hereinafter referred to as insulating pressure roller), the surface potential of the pressure roller 4 was about −2.6 kV and −3.0 kV (measuring limit of measuring instrument), which were higher in the negative side, than in the case of the conductive pressure roller. Also the application of the fixing film bias of −800 V rendered the surface of the pressure roller more negative.

In the configuration utilizing the insulating pressure roller, the presence/absence of the trailing and the electrostatic offset were confirmed on the actually printed image as described above, and it is found that, in the configuration utilizing an insulating pressure roller, presence of the charge eliminating needle 14 and an application of the fixing film bias can suppress both the trailing and the electrostatic offset. In the absence of the film bias, the offset can be suppressed though the trailing is generated.

It is therefore possible to suppress the toner offsetting by constituting at least the layers between the metal core and the surface of the pressure roller with insulating materials and by providing a charge eliminating member for eliminating the charge on the surface of the pressure roller. More preferably, it is possible to suppress not only the toner offsetting but also the trailing phenomenon by employing conductive discharge rollers and by applying a bias of a polarity same as the charging polarity of the toner, in addition to the configuration of employing the insulating pressure roller and eliminating the surface charge thereof.

From the results shown in Table 1, it is found, as explained above, that a satisfactory image without the trailing and the electrostatic offset can be obtained only in a configuration of applying a fixing film bias, employing an insulating elastic member in the pressure roller 4 and providing a charge eliminating member 14.

In the aforementioned experimental results, the conductive pressure roller has a negatively smaller surface potential in comparison with the insulating pressure roller, and the electrostatic offset should be less generated in the conductive pressure roller if according to the aforementioned mechanism for the electrostatic offset. However, as explained before, the electrostatic offset is a phenomenon generated by relative charge amounts on the surface of the pressure roller and on the surface of the fixing film, in the vicinity of the fixing nip. A conductive pressure roller has, because the silicone rubber in the elastic layer is conductive, has a far larger electrostatic capacity between the surface layer and the grounded metal core, in comparison with an insulating pressure roller. Therefore, a conductive pressure roller, even if having a smaller surface potential in comparison with that of an insulating pressure roller, having a far larger actual charge amount, and the electrostatic offset is facilitated by the relative relationship of this charge amount and the charge amount on the film surface. Also in case of a conductive pressure roller, a discharge to the charge eliminating needle is difficult because of the low surface potential on the surface of the pressure roller so that the charge eliminating effect is limited even when the charge eliminating needle is provided. Because of these reasons, the conductive pressure roller is assumed unable to suppress the electrostatic offset.

Also for simplifying and compactizing the fixing apparatus, the charge eliminating needle 14 may be integrated with another component positioned at the downstream side of the fixing in the conveying direction of the recording material, such as the separating guide 15.

Embodiment 2

Figure 7A:
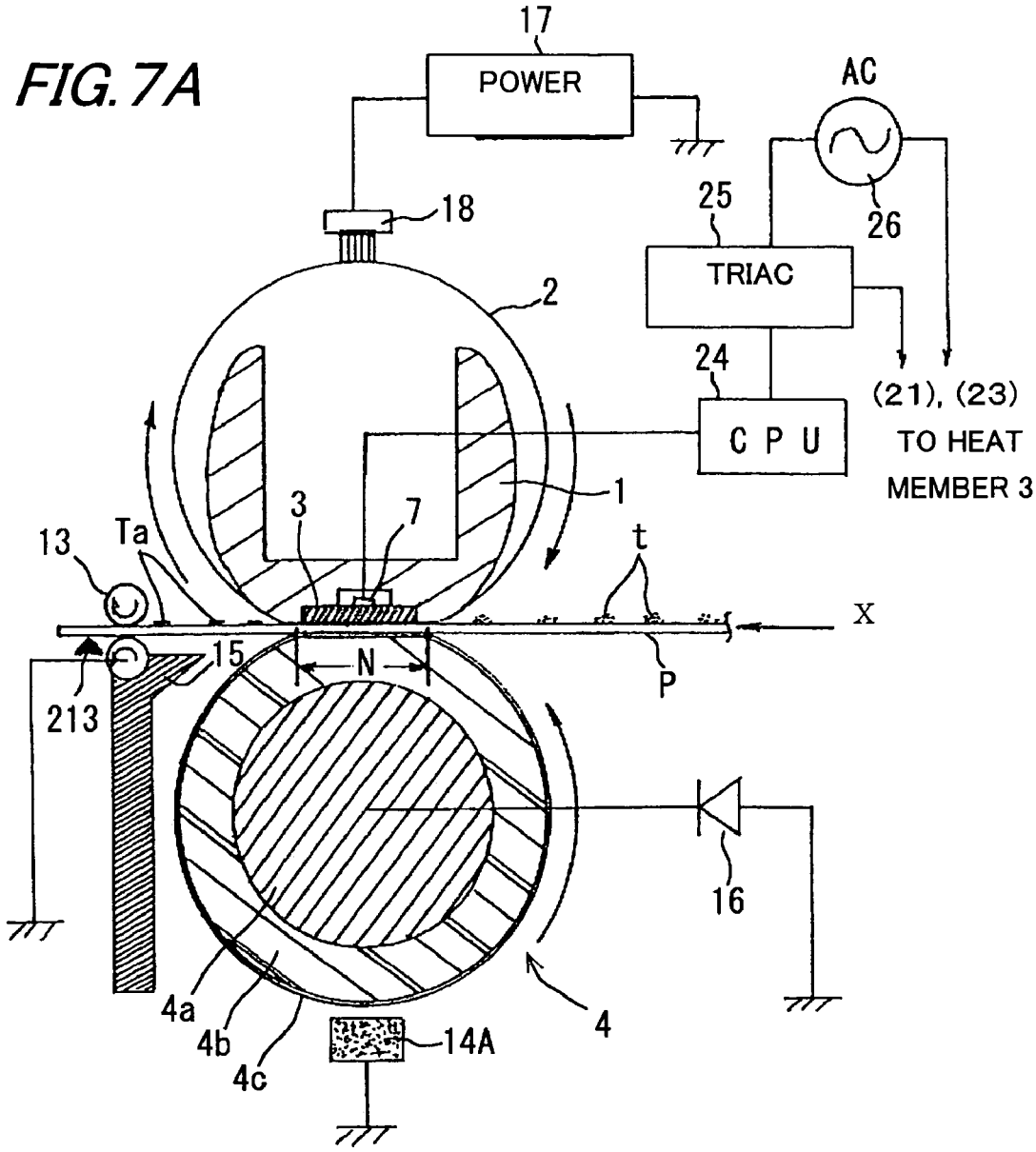
FIG. 7A is a schematic cross-sectional view showing a configuration of a film fixing device in an embodiment 2.

The embodiment 2 shows a film fixing device for a higher process speed and a larger number of prints per minute. FIG. 7A is a schematic view showing the configuration of a film fixing device of the present embodiment, of which components and operations are same as those in the film fixing device of the embodiment 1, except for a charge eliminating member.

Figure 7B:
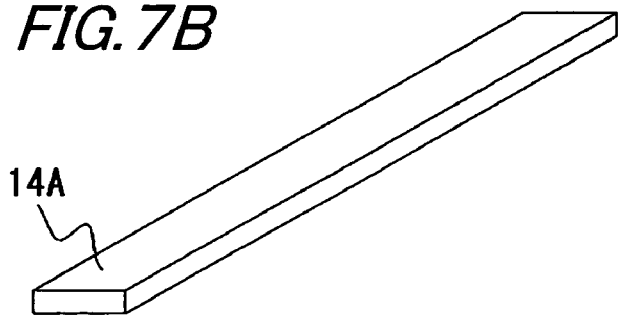
FIG. 7B is a view showing a charge eliminating cloth employed in the film fixing device shown in FIG. 7A.

In this embodiment 2, the charge eliminating member for the pressure roller 4 as the pressurizing rotary member is constituted, instead of the charge eliminating needle 14 in the film fixing device of the embodiment 1, of a sheet-shaped charge eliminating cloth 14A which is provided under the pressure roller 4 as shown in FIG. 7A and is grounded. The embodiment 2 employed a charge eliminating cloth #7784, manufactured by Okamoto Co., cut into a rectangular shape elongated in a direction perpendicular to the plane of FIG. 7A. The charge eliminating cloth 14A has a rectangular shape, as shown in FIG. 7B, with a longitudinal length (230 mm) same as that of the releasing layer 4*c* of the pressure roller 4 and a width of 5 mm.

In the following, there will be explained the configuration of the present embodiment, at first about the charge eliminating cloth 14A. The charge eliminating cloth employed in the embodiment 2 is formed as a non-woven cloth of conductive fibers such as of carbon. Such charge eliminating cloth has numberless discharge points (charge eliminating points) such as ends of the conductive fibers, thus having a higher charge eliminating efficiency in comparison with the charge eliminating needle 14.

The present embodiment 2 employs a higher process speed of 260 mm/sec, corresponding to a print speed of 45 ppm. With an increase in the process speed, it is necessary to increase the width of the fixing nip portion N in order to secure the time for pressing and heating the unfixed toner, so that the pressure roller 4 is given an external diameter of 30 mm with an increased pressure. In order to prevent bending of the core metal 4*a* of the pressure roller 4 by the increased pressure, the metal core 4*a* requires a larger diameter. Therefore, the elastic layer 4*b* was given a thickness of 2.5 mm. It was thus confirmed that the toner can be sufficiently pressed and heated at the process speed of 260 mm/sec.

In the embodiment 2, because of the thinner insulating elastic layer 4*b* in comparison with that in the pressure roller 4 in the embodiment 1, the electrostatic capacity between the grounded metal core 4*a* and the surface of the pressure roller becomes larger. For this reason, in order to reduce the charge amount on the surface of the pressure roller in the vicinity of the fixing nip to a level not generating the electrostatic offset, the surface of the pressure roller has to be charge eliminated to a potential lower than that in the embodiment 1. Therefore, in the configuration and operating conditions of the embodiment 2, the surface of the pressure roller has to be charge eliminated more efficiently than in the embodiment 1. In consideration of this point, the embodiment 2 employs the aforementioned sheet-shaped charge eliminating cloth 14A of a higher charge eliminating efficiency. A distance between the surface of the charge eliminating cloth and the surface of the pressure roller is preferably 0.7 to 3 mm, but a distance of 1.5 mm was employed in the embodiment 2.

Levels of trailing and electrostatic offset were confirmed on images printed with the film fixing device of the embodiment 2 shown in FIGS. 7A and 7B and with a higher process speed of 266 mm/sec and 45 ppm. The recording material and the temperature-humidity conditions employed in the confirmation were made same as those in the embodiment 1. The film fixing device shown in FIG. 7A, employing the charge eliminating cloth shown in FIG. 7B, provided a satisfactory image without the trailing or the electrostatic offset.

Thus the configuration of the embodiment 2 can suppress both the trailing and the offset and provide a satisfactory image even at a higher process speed of 266 mm/sec.

Also a similar effect can be obtained by employing, instead of the charge eliminating cloth 14A, a charge eliminating brush formed by mounting a plurality of bundles of conductive fibers such as SUS fibers on a conductive substrate such as an aluminum substrate, or by employing a plurality of charge eliminating needles.

Embodiment 3

Figure 8:
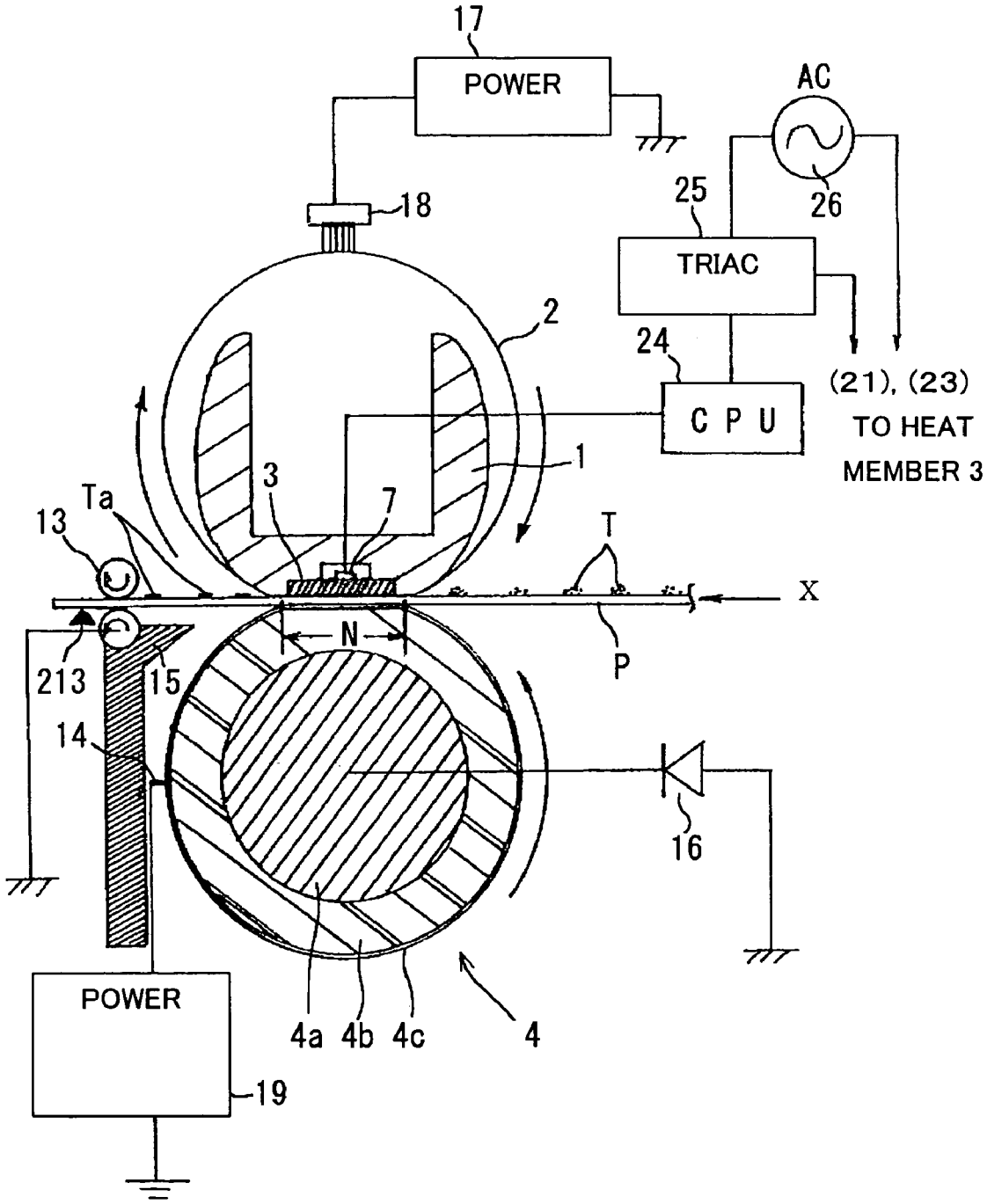
FIG. 8 is a schematic cross-sectional view showing a configuration of a film fixing device in an embodiment 3.

FIG. 8 is a schematic cross-sectional view of a film fixing device of an embodiment 3, of which components and operations are same as those in the film fixing device of the embodiment 1, except for a structure between the charge eliminating member and the ground.

In the present embodiment 3, a voltage of a polarity opposite to that of the toner is applied from a power source 19 to a charge eliminating needle 14 constituting the charge eliminating member for the pressure roller 4. In the present embodiment, a voltage of +1 kV, having a polarity opposite to that of the toner, is applied at the same timing as the bias application to the fixing film 2 (film bias application).

Functions of the present embodiment will be explained in the following. In the embodiment 3, the point of the charge eliminating needle, having a potential of +1 kV, can have a larger potential difference to the surface of the pressure roller. Because of a larger potential difference between the charge eliminating needle 14 and the surface of the pressure roller, a charge eliminating effect similar to that in the embodiment 1 can be attained even with a larger distance between the charge eliminating needle 14 and the surface of the pressure roller. More specifically, the charge eliminating effect can be attained even at a distance of 4 mm between the charge eliminating needle 14 and the surface of the pressure roller, namely a distance larger by 1 mm.

The present configuration therefore can increase the design freedom, such as tolerances in the components of the fixing device and in assembling thereof. Also as the charge eliminating ability by the charge eliminating needle 14 is substantially improved, the types of the recording material acceptable in the image forming apparatus can be increased.

As explained above, a voltage application to the charge eliminating needle 14 allows to obtain a satisfactory image in more stable manner, whereby increasing the design freedom of the fixing device and allowing to increase the types of the acceptable recording material.

Embodiment 4

The present invention is effectively and widely applicable to a fixing apparatus for fixing a toner image by pinching and conveying a recording material, bearing an unfixed toner image, by a nip portion formed by a heating rotary member and a pressurizing rotary member, and is not limited to the film fixing devices as shown in Embodiments 1-3.

Figure 9:
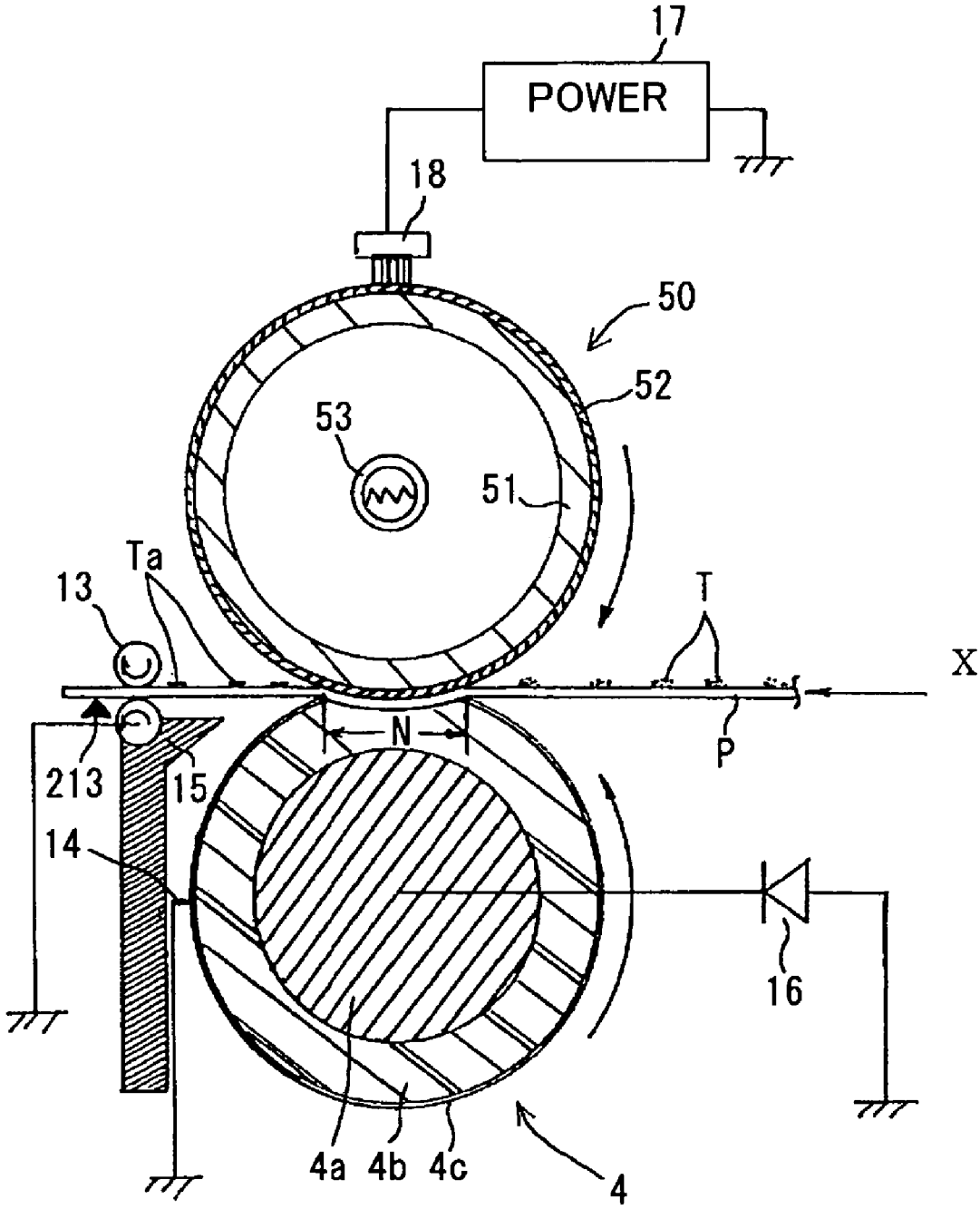
FIG. 9 is a schematic cross-sectional view showing a configuration of a fixing device of heat roller type in an embodiment 4.

The present embodiment 4 shows an application to a fixing device of heat roller type as shown in FIG. 9, in which shown is a fixing roller (heat roller) 50 serving as a heating rotary member. The fixing roller 50 is formed by a hollow metal roller 51 such as of aluminum, of which surface is coated with a releasing layer 52 such as of PFA or PTFE, and such fixing roller is heated from the interior by a heat source 53 such as a halogen heater and a surface temperature is controlled at a predetermined fixing temperature by an unillustrated control circuit.

Such fixing roller and an elastic pressure roller 4 are kept in a mutual pressurized contact to form a fixing nip portion N, and such pair of rollers are rotated to pinch and convey a recording material P, bearing an unfixed toner image T and introduced into the fixing nip portion N. In the course of conveying, the unfixed toner image T is fixed as a fixed image Ta onto the recording material P by the heat of the fixing roller 50 and the pressure of the fixing nip portion N. Components similar to those in the film fixing device of Embodiment 1 are represented by same symbols and will not be explained further.

A metal core 51 of the fixing roller 50 receives a bias of a polarity same as the charging polarity of the toner, from bias application means 17, 18. In the vicinity of the pressure roller 4 serving as a pressurizing rotary member, a charge eliminating needle 14 is provided as a charge eliminating member not in contact with the pressure roller 4 and is grounded.

Such fixing apparatus of heat roller type can suppress both the trailing and the electrostatic offset, thus providing a satisfactory image, by functions similar to those of the film fixing device of Embodiment 1.

It is also possible to employ, instead of the charge eliminating needle 14 as the charge eliminating member for the pressure roller, a sheet-shaped charge eliminating cloth 14A in Embodiment 2 or a charge eliminating brush. It is furthermore possible to apply a bias to the charge eliminating member as in Embodiment 3.

Others,

1) Means to form the unfixed toner image T on the recording material P is not limited to an electrophotographic process of transfer type, but can be any other toner image forming process of direct or transfer (indirect) type.
2) The heating rotary member and the pressurizing rotary member are not limited to rollers but may also be formed as belts.

The present invention is not limited to the foregoing embodiments but includes any and all modifications within the technical concept.

This application claims priority from Japanese patent application Nos. 2004-281673 filed Sep. 28, 2004 and 2005-271971 filed Sep. 20, 2005, which are hereby incorporated by reference herein.

What is claimed is:

1. An image heating apparatus for heating a toner image formed on a recording material, comprising:

a rotatable member;

a pressure roller which contacts with said rotatable member;

wherein the recording material is adapted to be heated while being conveyed by a nip portion between said rotatable member and said pressure roller; and a charge eliminating member for eliminating a charge on a surface of said pressure roller, said charge eliminating member being grounded;

wherein said pressure roller includes an electrically insulating elastic layer and an electrically insulating releasing layer, discharge does not occur between said charge eliminating member and the recording material, and discharge does occur between said charge eliminating member and the surface of said pressure roller, and wherein said elastic layer has a volume resistivity equal to or higher than $10^{12}$ Ω·cm, and said releasing layer has a volume resistivity equal to or higher than $10^{16}$ Ω·cm.

2. An image heating apparatus according to claim 1, wherein said pressure roller includes a metal core, and a resistance between said metal core and the surface of said pressure roller is equal to or higher than $10^{16}$ Ω.

3. An image heating apparatus according to claim 1, wherein said charge eliminating member is provided along a longitudinal direction of said pressure roller.

4. An image heating apparatus according to claim 3, wherein said charge eliminating member is a metal plate having a comb-shaped end.

5. An image heating apparatus according to claim 3, wherein said charge eliminating member is a cloth formed from conductive fibers.

6. An image heating apparatus according to claim 1, wherein said charge eliminating member is spaced from the surface of said pressure roller.

7. An image heating apparatus according to claim 6, wherein a distance between the end of said charge eliminating member and the surface of the pressure roller is within a range of 0.7 to 3 mm.

8. An image heating apparatus according to claim 1, further comprising:

bias application means for applying a bias of a polarity same as a charging polarity of the toner to said rotatable member, and an electrically conductive member which is grounded and provided on a downstream side of the nip portion in a moving direction of the recording material, wherein when the recording material contacts both said rotatable member and said electrically conductive member, a current flows between said electrically conductive member and said bias application means through the recording material and said rotatable member.

9. An image heating apparatus according to claim 1, wherein said charge eliminating member is applied a bias of a polarity opposite to the charging polarity of the toner.

10. An image heating apparatus according to claim 8, wherein said electrically conductive member is a sheet discharge roller.

11. An image heating apparatus according to claim 1, wherein said rotatable member is flexible.

12. An image heating apparatus according to claim 11, comprising a heater which contacts with an internal surface of said flexible rotatable member, and the nip portion is formed by said heater and said pressure roller through said flexible rotatable member.

13. An image heating apparatus according to claim 1, wherein said rotatable member has rigidity, and the nip portion is formed by said rotatable member and said pressure roller.

* * * * *

UNITED STATES PATENT AND TRADEMARK OFFICE

CERTIFICATE OF CORRECTION

PATENT NO. : 7,305,208 B2
APPLICATION NO. : 11/234306
DATED : December 4, 2007
INVENTOR(S) : Hiroshi Inoue et al.

It is certified that error appears in the above-identified patent and that said Letters Patent is hereby corrected as shown below:

ON THE TITLE PAGE
At Item (56), Foreign Patent Documents:
"59157672A" should read --59-157672A--.
"59157673A" should read --59-157673A--.
"59157674A" should read --59-157674A--.
"59157675A" should read --59-157675A--.

COLUMN 4
Line 37, "of" should be deleted.

COLUMN 5
Line 1, "objects" should read --object--.
Line 17, "contact" should read --contacts--.

COLUMN 9
Line 55, "form" should read --from--.

COLUMN 11
Line 39, "where by" should read --whereby--.

Signed and Sealed this

Seventeenth Day of February, 2009

JOHN DOLL
*Acting Director of the United States Patent and Trademark Office*